US005318712A

United States Patent [19]

Lange et al.

[11] Patent Number: 5,318,712

[45] Date of Patent: Jun. 7, 1994

[54] LUBRICANTS, GREASES, AQUEOUS FLUIDS AND CONCENTRATES CONTAINING ADDITIVES DERIVED FROM DIMERCAPTOTHIADIAZOLES

[75] Inventors: Richard M. Lange, Euclid; Syed Q. A. Rizvi, Painesville; Richard E. Gapinski, Mentor, all of Ohio

[73] Assignee: The Lubrizol Corporation, Wickliffe, Ohio

[21] Appl. No.: 960,064

[22] Filed: Oct. 13, 1992

[51] Int. Cl.[5] ..... C10M 133/00; C10M 135/00

[52] U.S. Cl. ..... 252/47.5; 252/47; 252/37; 252/38; 252/39

[58] Field of Search ..... 252/47.5, 34, 35, 39

[56] References Cited

U.S. PATENT DOCUMENTS

| | | | |
|---|---|---|---|
| 2,703,784 | 3/1955 | Fields | 252/32.7 |
| 2,719,125 | 9/1955 | Roberts | 252/46.7 |
| 2,719,126 | 9/1955 | Fields | 252/47 |
| 2,760,933 | 8/1956 | Fields | 252/32.7 |
| 2,764,547 | 9/1956 | Fields | 252/32.7 |
| 2,799,651 | 7/1957 | Richardson | 252/32.7 |
| 2,799,652 | 7/1957 | Fields | 252/32.7 |
| 2,799,654 | 7/1957 | Sabol | 252/32.7 |
| 2,836,564 | 5/1958 | Roberts | 252/47.5 |
| 2,850,453 | 9/1958 | Fields | 252/32.7 |
| 3,663,561 | 5/1972 | Blaha | 260/302 |
| 3,840,549 | 10/1974 | Blaha | 260/302 |
| 3,929,652 | 12/1975 | Seni et al. | 252/46.7 |
| 4,097,387 | 6/1978 | Caspari | 252/47.5 |
| 4,193,882 | 3/1980 | Gemmill, Jr. | 252/47.5 |
| 4,210,544 | 7/1980 | Burton et al. | 252/47.5 |
| 4,301,019 | 11/1981 | Horodysky et al. | 252/49.6 |
| 4,382,869 | 5/1983 | Horodysky et al. | 252/47.5 |
| 4,432,847 | 2/1984 | Fields | 204/158 |
| 4,487,706 | 12/1984 | Lam | 252/47 |
| 4,584,114 | 4/1986 | Gemmill et al. | 252/47.5 |
| 5,055,584 | 10/1991 | Karol | 548/142 |
| 5,138,065 | 8/1992 | Karol | 548/142 |
| 5,188,746 | 2/1993 | Davis | 252/47.5 |

FOREIGN PATENT DOCUMENTS 0289964 11/1988 European Pat. Off. .

OTHER PUBLICATIONS

J. Org. Chem 21, 497 (1956) Ellis K. Fields Addition of 1,3,4-Thiadiazole-2,5-dithiol to Olefinic Compounds.

*Primary Examiner*—Asok Pal
*Assistant Examiner*—P. Achutamurthy
*Attorney, Agent, or Firm*—Renner, Otto, Boisselle & Sklar

[57] ABSTRACT

This invention relates to a composition comprising (A) a major amount of an oil of lubricating viscosity and (B) a minor amount of (i) a reaction product of (a) at least one dimercaptothiadiazole, and (b) at least one alpha, beta-unsaturated ester prepared by reacting an alpha, beta-unsaturated carboxylic acylating agent with a hydroxy compound, or (ii) a salt of the reaction product, provided that when the acylating agent is a monocarboxylic acylating agent then the hydroxy compound is a monohydroxy compound, and provided that when the ester is formed from a maleic acylating agent, then the ester is formed from a sulfur-containing hydroxy compound or a combination of a polyhydroxy compound and a monohydroxy. The invention also relates to aqueous fluids, greases, and concentrate compositions containing the reaction products and its salts. These additives generally show an ability to improve antiwear (including extreme pressure) and antioxidation properties of lubricants, aqueous fluids, and greases.

33 Claims, No Drawings

LUBRICANTS, GREASES, AQUEOUS FLUIDS AND CONCENTRATES CONTAINING ADDITIVES DERIVED FROM DIMERCAPTOTHIADIAZOLES

FIELD OF THE INVENTION

This invention relates to dimercaptothiadiazole derivatives in lubricants, greases, aqueous fluids and concentrates.

INTRODUCTION TO THE INVENTION

Lubrication involves the process of friction reduction, accomplished by maintaining a film of a lubricant between surfaces which are moving with respect to each other. The lubricant prevents contact of the moving surfaces, thus greatly lowering the coefficient of friction. In addition to this function, the lubricant also can be called upon to perform heat removal, containment of contaminants, and other important functions.

Since lubricants for different uses must operate under different conditions, numerous additives have been developed to establish or enhance various properties of lubricants. Representative types of additives which are used include viscosity improvers, detergents, dispersants, antioxidants, extreme pressure additives, corrosion inhibitors and several others. Very frequently, combinations of additive types are required. In addition, certain additives can have more than one function in a lubricant.

Of particular importance in many applications are antiwear agents, many of which function by a process of interaction with the surfaces, thereby providing a chemical film which prevents metal-to-metal contact under high load conditions. Wear inhibitors which are useful under extremely high load conditions are frequently called "extreme pressure agents." Extreme pressure agents are frequently selected from the following chemical types: zinc organodithiophosphates; sulfurized olefins; chlorinated waxes; amine salts of phosphate esters; phosphites; and others. Certain of these materials, however, must be used judiciously in certain applications due to their property of accelerating corrosion of metal parts, such as bearings. In addition, some applications require very low concentrations of certain elements, such as phosphorus, which restricts the utility of otherwise quite useful extreme pressure agents.

U.S. Pat. No. 2,764,547 to Fields describes compounds which can be added to lubricants for the purpose of inhibiting the corrosion of silver-containing metal parts. These compounds are prepared by reacting 2,5-dimercapto-1,3,4-thiadiazole with an unsaturated cyclic compound containing at least about 5 carbon atoms. Examples of suitable cyclic compounds are: dipinene; pinene; alpha-methyl styrene; and styrene. The compounds are used to control the corrosion of silver which is normally exhibited by sulfur-containing detergent additives for lubricating oil.

U.S. Pat. No. 2,836,564, issued to Roberts relates to corrosion inhibitors and compositions containing the same. The corrosion inhibitors are condensation products of alpha-halogenated aliphatic mono-carboxylic acids and 2,5-dimercapto-1,3,4-thiadiazole. U.S. Pat. No. 4,193,882 to Gemmill, Jr. is concerned with additives which are effective for inhibiting metal corrosion in lubricating oils and greases. The additives are prepared by reacting oleic acid with 2,5-dimercapto-1,3,4-thiadiazole.

Horodysky et al, in U.S. Pat. Nos. 4,301,019 and 4,382,869, describe the preparation of friction reducing, non corrosive additives for lubricants. The additives are prepared by reacting unsaturated esters containing at least one free hydroxyl group, with thiadiazoles, and borating the reaction product. Alternatively, borated hydroxyl containing unsaturated esters can be reacted with the thiadiazole.

U.S. Pat. No. 4,585,114 to Gemmill et al discloses friction reducing and anticorrosion additives for lubricants, produced by reacting 2,5-dimercapto-1,3,4-thiadiazole with unsaturated esters, wherein the esters are prepared from various alcohols and acids, one of which must have at least 10 carbon atoms. Examples of the patent teach reaction products using jojoba oil, oleyl oleate and pentaerythritol tetraoleate.

European Patent Application, EP 289,964 relates to maleic acid derivatives of 2,5-dimercapto-1,3,4-thiadiazoles and lubricating compositions containing the same. These additives are useful as antiwear and antioxidation agents in lubricating compositions.

Fields in "Addition of 1,3,4-thiadiazole-2,5-dithiol to Olefinic Compounds", Journal of Organic Chemistry, Vol. 21, pg. 497–499 (1956) describes addition of dithiolthiadiazole to olefinic compounds, which include acrylic acid and 2-ethylhexyl acrylate.

SUMMARY OF THE INVENTION

This invention relates to a composition comprising (A) a major amount of an oil of lubricating viscosity and (B) a minor amount of (i) a reaction product of (a) at least one dimercaptothiadiazole, and (b) at least one alpha, beta-unsaturated ester prepared by reacting an alpha, beta-unsaturated carboxylic acylating agent with a hydroxy compound, or (ii) a salt of the reaction product; provided that when the acylating agent is a monocarboxylic acylating agent then the hydroxy compound is a monohydroxy compound, and provided that when the ester is formed from a maleic acylating agent, then the ester is formed from a sulfur-containing hydroxy compound or a combination of a polyhydroxy compound and a monohydroxy. The invention also relates to aqueous fluids, greases and concentrate compositions containing the reaction products and its salts. These additives generally show an ability to improve antiwear, antiweld, extreme pressure, and oxidation inhibiting properties of lubricants, aqueous fluids, and greases.

DETAILED DESCRIPTION OF THE INVENTION

The term "hydrocarbyl" includes hydrocarbon, as well as substantially hydrocarbon groups. Substantially hydrocarbon describes groups which contain hetero atom substituents which do not alter the predominantly hydrocarbon nature of the group.

Examples of hydrocarbyl groups include the following:

(1) hydrocarbon substituents, that is, aliphatic (e.g., alkyl or alkenyl), alicyclic (e.g., cycloalkyl, cycloalkenyl) substituents, aromatic-substituted aliphatic substituents or aromatic-substituted alicyclic substituents, or aliphatic- and alicyclic-substituted aromatic substituents and the like as well as cyclic substituents wherein the ring is completed through another portion of the molecule (that is, for example, any two indicated substituents may together form an alicyclic radical);

(2) substituted hydrocarbon substituents, that is, those substituents containing non-hydrocarbon groups which, in the context of this invention, do not alter the predominantly hydrocarbon nature of the substituent; those skilled in the art will be aware of such groups (e.g., halo (especially chloro and fluoro), hydroxy, mercapto, nitro, nitroso, sulfoxy, etc.);

(3) hetero atom substituents, that is, substituents which will, while having a predominantly hydrocarbon character within the context of this invention, contain an atom other than carbon present in a ring or chain otherwise composed of carbon atoms (e.g. alkoxy or alkylthio). Suitable heteroatoms will be apparent to those of ordinary skill in the art and include, for example, sulfur, oxygen, nitrogen and such substituents as, e.g., pyridyl, furyl, thienyl, imidazolyl, etc. In general, no more than about 2, preferably no more than one, hetero atom substituent will be present for every ten carbon atoms in the hydrocarbyl group. Typically, there will be no such hetero atom substituents in the hydrocarbyl group. In one embodiment, the hydrocarbyl group is purely hydrocarbon.

Mercaptothiadiazole

The present invention involves derivatives of dimercaptothiadiazoles. Thiadiazoles, which are cyclic compounds in which the ring contains 2 nitrogen, 2 carbon, and 1 sulfur atoms, are discussed by W. R. Sherman, "The Thiadiazoles," in Heterocyclic Compounds, Volume 7, R. C. Elderfield Editor, John Wiley & Sons, Inc. New York, Pages 541–626, 1961; the synthesis and properties of many thiadiazoles are described in this reference. The dimercaptothiadiazoles which are particularly useful in this invention are represented by formulae as follows:

2,5-Dimercapto-1,3,4-thiadiazole

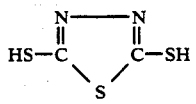

3,5-Dimercapto-1,2,4-thiadiazole

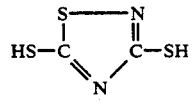

3,4-Dimercapto-1,2,5-thiadiazole

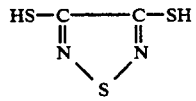

4,5-Dimercapto-1,2,3-thiadiazole

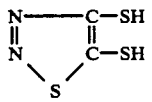

The compound which is most readily available and particularly preferred for purposes of the present invention, is 2-5-Dimercapto-1,3,4-thiadiazole, sometimes referred to herein as "DMTD." It should be understood, however, that the term DMTD, as used herein, can encompass any of the dimercaptothiadiazoles or mixtures of two or more dimercaptothiadiazoles. A convenient preparation of 2,5-dimercapto-1,3,4-thiadiazole is the reaction of 1 mole of hydrazine or a salt of hydrazine with 2 moles of carbon disulfide in an alkaline medium. The product can be recovered by acidification of the reaction mixture.

Alpha, Beta-Unsaturated Esters

Alpha, beta-unsaturated esters (B-i-b) are reacted with DMTD (B-i-a) to form the reaction products (B-i) and their salts (B-ii). The alpha, beta-unsaturated ester is prepared by reacting an alpha, beta-unsaturated carboxylic acylating agent with a hydroxy compound, provided that when the acylating agent is a monocarboxylic acylating agent then the hydroxy compound is a monohydroxy compound, and provided that when the ester is formed from a maleic acylating agent, then the ester is formed from a hydroxy-containing sulfur compound or from a combination of a polyhydroxy compound and a monohydroxy compound. The carboxylic acylating agents include acids, anhydrides, acid halides, or lower alkyl esters ($C_{1-7}$ alkyl esters). Examples of alpha, beta-unsaturated carboxylic acylating agents include acrylic, methacrylic, crotonic, maleic, fumaric, itaconic, and citraconic acylating agents, preferably acrylic, methacrylic, or maleic acylating agents, with acrylic and methacrylic acylating agents being most preferred.

The above acylating agents are reacted with at least one hydroxy compound. The hydroxy compound generally contains at least about 4 carbon atoms. In one embodiment, the hydroxy compound contains from about 4, up to about 30, or to about 24, or to about 12, or to about 8 carbon atoms. The hydroxy compounds may be represented by the general formula $R_1(OH)_m$ wherein $R_1$ is a monovalent or polyvalent hydrocarbyl group joined to the —OH groups through a carbon bond, and m is an integer of from 1 to about 10, or to about 4. In one embodiment, $R_1$ contains at least about 4 carbon atoms. $R_1$ generally contains from about 4, or about 6 to about 30, or to about 24 carbon atoms. When m is 1, $R_1$ is an alkyl or hydroxyalkyl group, preferably an alkyl group. Examples of $R_1$ include butyl, pentyl, hexyl, octyl, decyl, and dodecyl groups. When m is two, $R_1$ is an alkylene group or a hydroxy alkyl-substituted alkylene group.

The hydroxy compounds may be aliphatic compounds, such as monohydric and polyhydric aliphatic alcohols, or aromatic compounds, such as phenols and naphthols. The aromatic hydroxy compounds from which the esters may be derived are illustrated by the following specific examples: phenol, beta-naphthol, alpha-naphthol, cresol, resorcinol, catechol, p,p-dihydroxybiphenyl, 2-chlorophenol, 2,4-dibutylphenol, etc.

In one embodiment, the hydroxy compounds are polyhydric alcohols, such as alkylene polyols. Generally, the polyhydric alcohols contain from 2, or about 3, to about 40, or to about 20, or to about 12 carbon atoms; and from 2 to about 10, or to about 6, or to about 4 hydroxy groups. Polyhydric alcohols include ethylene glycols, including di-, tri- and tetraethylene glycols; propylene glycols, including di-, tri- and tetrapropylene glycols; glycerol; butanediol; butanetriol; hexanediol; hexanetriol; sorbitol; arabitol; mannitol; sucrose; fructose; glucose; cyclohexanediol; erythritol; and pentaerythritols, including di- and tripentaerythritol; preferably, diethylene glycol, triethylene glycol, glycerol, sorbitol, pentaerythritol and dipentaerythritol.

In one embodiment, the hydroxy compounds are monohydroxy compounds. Monohydroxy compounds include alcohols and their substituted derivatives, e.g., nitro-, halo-, alkoxy-, hydroxy-, carboxy-, etc. Examples of alcohols include propanols, butanols, pentanols, hexanols, octanol and dodecanols. Specific examples of alcohols include, for example, ethanol, n-propanol, isopropanol, 1-butanol, 2-butanol, 2-methylpropanol, 1-pentanol, 2-pentanol, 3-pentanol, 2-methyl-1-butanol, 3-methyl-2-pentanol, 1-hexanol, 2-hexanol, 3-hexanol, 4-methyl-2-pentanol, 2-methyl-2-pentanol, cyclohexanol, 2-ethylhexanol, 1-octanol, etc.

In one embodiment, the alpha, beta-unsaturated ester (b) is formed from a combination of polyhydric alcohols and monohydric alcohols. The combination includes any of the alcohols described above. Examples of mixtures include neopentyl glycol and 1-octanol, ethylene glycol and 2-ethylhexanol, and glycerol and 2-methyl-1-butanol.

In another embodiment, the alpha, beta-unsaturated ester (b) is formed from a hydroxyl-containing sulfur compound, preferably a hydroxythioether. The hydroxythioethers may be represented by the formula $R_2$—(-S—$R_3$—OH)$_n$ wherein $R_2$ is a hydrocarbyl group, $R_3$ is a hydrocarbylene, preferably an alkylene group, and n is from 1 to about 6. Generally $R_2$ contains up to 30, preferably from 1, or about 6, or about 8 up to about 24, or to about 18 carbon atoms. Generally, $R_3$ contains from 2 to about 8, or to about 4 carbon atoms. n is preferably one. In one embodiment, $R_2$ is an alkyl group. Examples of $R_2$ include an octyl, t-octyl, t-nonyl, n-decyl, t-dodecyl, n-dodecyl, n-tetradecyl, and n-hexadecyl.

Specific examples of these hydroxythioethers include 1) n-$C_8H_{17}SCH_2CHOHCH_3$
2) n-$C_{12}H_{25}SCH_2CHOHCH_3$
3) t-$C_{12}H_{25}SCH_2CHOHCH_3$
4) n-$C_{10}H_{21}SCH_2CH_2OH$
5) t-$C_9H_{19}SCH_2CH(CH_3)OCH_2CHOHCH_3$
6) $C_{11-14}H_{23-29}SCH_2CHOHCH_3$(i.e., a mixture of hydroxythioethers)
7) n-$C_{16}H_{33}SCH_2CHOHCH_3$
8) n-$C_{14}H_{29}SCH_2CH_2OH$
9) n-$C_{14}H_{29}SCH_2CH_2OCH_2CH_2OH_2$
10) n-$C_{12}H_{25}SCH_2CH_2CH_2OH$ There are several routes for the preparation of the hydroxythioethers. For example, hydroxythioethers can be formed by the reaction of a monomercaptan with an epoxide. This reaction can be conducted at temperatures ranging from about 30° C. up to just below the decomposition temperature of the reactants or products and is preferably carried out at from about 40° C. to about 200° C. The use of a catalyst facilitates the reaction, and a basic catalyst (e.g., sodium metal or sodium hydroxide) is usually preferred. At approximately equimolar amounts of monomercaptan and epoxide and at lower reaction temperatures (e.g., 50° C. to 130° C.) a monocondensation product is favored.

Any unreacted monomercaptan starting material and/or any unreacted epoxide can remain in the final reaction product and be used in total as an additive for the lubricating oil compositions. Normally, epoxides which can be readily removed by distillation will be removed and recovered. It is generally preferred to use at least a stoichiometrically equivalent amount of epoxide so that all the mercapto groups (i.e., —SH) are converted to thioether groups.

The mercaptans useful in this preparation of the hydroxythioethers may be primary, secondary or tertiary mercaptans. Many of these materials are commercially available. Tertiary mercaptans prepared from tri- and tetrapropene and di- and triisobutylene base hydrocarbons are preferred.

Suitable epoxides for use in the above preparation of the hydroxythioethers include ethylene oxide, propylene oxide, 1,2-epoxyhexane, 1,2-epoxyhexadecane, 1,2-epoxybutane, 3,4-epoxyheptane, 1,2-epoxycyclohexene, 4,5-epoxydecane; 1,2-epoxy-5-oxaheptane; 1,2-epoxy-6-propyltridecane, 9,10-epoxystearic acid esters, styrene oxides, para-chlorostyrene oxide, and mixtures of two or more of these. The terminal alkylene oxides, especially the terminal lower ($C_{1-7}$) alkylene oxides, are preferred with ethylene oxide and propylene oxide or mixtures thereof being the most preferred epoxides.

Useful hydroxythioethers are described in U.S. Pat. Nos. 4,031,023, 2,863,799; 2,776,997 and 2,570,050. These patents are incorporated by reference for their disclosures of hydroxythioethers.

In another embodiment, the alpha, beta-unsaturated ester (b) is an alpha, beta-polyunsaturated ester. The polyunsaturated ester may contain from 2, or 3, or 4 unsaturated groups. The polyunsaturated ester may be prepared by esterifying the above described alpha, beta-unsaturated carboxylic acylating agents with a polyhydric alcohol, such as those described above. These polyunsaturated esters include di-, tri- and tetraacrylates, as well as di-, tri- and tetramethacrylates. Examples of these polyunsaturated esters include diethyleneglycol diacrylate, diethyleneglycol dimethacrylate, dipropyleneglycol dimethacrylate, trimethylolethane triacrylate, trimethylolpropane triacrylate, trimethylolethane triacrylate, trimethylolpropane trimethacrylate and ethyleneglycol dimaleate, etc.

Generally, about 0.5 to about 4 moles of DMTD are reacted with 1 mole of alpha, beta-unsaturated ester. When the alpha, beta-unsaturated ester is monounsaturated, then 1 mole of the ester is reacted with from about 0.5 up to about 1 mole of DMTD. When the alpha, beta-unsaturated ester is diunsaturated, then 1 mole of alpha, beta-unsaturated ester is reacted with from 1 to about 2 moles of DMTD. When the alpha, beta-unsaturated ester is triunsaturated, then 1 mole of the ester is reacted with from about 1.5 to about 3 moles of DMTD. When the alpha, beta-unsaturated ester is tetraunsaturated, then 1 mole of the ester is reacted with from about 2 to about 4 moles of DMTD.

While it is not desired to be bound to any particular theory, it is believed that the reaction products of DMTD (a) and alpha, beta-unsaturated esters (b) are addition products in which the mercapto sulfur atom bonds to one of the olefinic carbon atoms; the mercapto hydrogen atom also attaches to the other carbon. This reaction is described by A. K. Fields, "Addition of 1,3,4-Thiadiazole-2,5-dithiol to Olefinic Compounds," *Journal of Organic Chemistry*, Volume 21, pages 497–499 (1956), which is incorporated herein by reference. Either or both of the mercapto functions in DMTD can be reacted. When 1 mercapto group of the DMTD is reacted with an alpha, beta-unsaturated ester, then the product is a "mono adduct". When both mercapto groups of the DMTD are reacted with an alpha, beta-unsaturated ester, then the adduct is a "bis adduct". A mixture of mono and bis adducts may be prepared by reacting 1 mole of DMTD with an amount of alpha, beta-unsaturated ester sufficient to provide more than 1 but less than 2 unsaturation groups per mole of DMTD. Products of mixed functionality may be prepared by reacting the DMTD with a combination of alpha, beta-unsaturated esters.

In one embodiment, the reaction product or its salt is a "mono adduct". The inventors have discovered that mono adducts and their salts provide beneficial extreme pressure and/or antiwear properties to lubricating oils, greases and aqueous fluids.

(ii) Salts of the Reaction Products

Salts of the reaction products of alpha, beta-unsaturated esters (b) and dimercaptothiadiazoles (a) are prepared from a reaction product which contains mercapto groups. The salt is believed to form from the interaction of the mercapto group with a base such as a metal or ammonium base. For example, when 1 mole of DMTD is reacted with less than 2 moles, such as 1 mole, of an alpha, beta-monounsaturated ester, then the final product contains free mercapto groups which are capable of forming salt.

The salt may be prepared by reacting a metallic base, ammonia, or an amine with one or more reaction products of DMTD (a) and an alpha, beta-unsaturated ester (b). The metal base can be a metal or a metal containing composition. Suitable metals include: the alkali metals, particularly lithium, sodium and potassium; the alkaline earth metals, particularly magnesium, calcium, strontium and barium; the transition metals, particularly titanium, molybdenum, manganese, iron, cobalt, nickel, and zinc; metals of the boron and aluminum column of the periodic table; and metals of the silicon and tin column of the periodic table. Depending upon their particular reactivities, the metal may be used in elemental form, or may be present in a metal-containing composition, such as a metal oxide, metal hydroxide, metal carbonate compound, and the like. While is not desired to be bound to any particular theory, it is believed that salts are formed by replacement of a free mercapto hydrogen atom by a metal atom.

The amines which are used to form the salts include monoamines or polyamines. The monoamines generally contain from 1 to about 24 or to about 12, or to about 6 carbon atoms. Examples of monoamines useful in the present invention include methylamine, ethylamine, propylamine, butylamine, octylamine, and dodecylamine. Examples of secondary amines include dimethylamine, diethylamine, dipropylamine, dibutylamine, methylbutylamine, ethylhexylamine, etc. Tertiary amines include trimethylamine, tributylamine, methyldiethylamine, ethyldibutylamine, etc.

tertiary Aliphatic Primary Amine

In one embodiment, the amine is a tertiary-aliphatic primary amine. Generally, the aliphatic group, preferably an alkyl group, contains from about 4, or about 6, or about 8 to about 30, or to about 24 carbon atoms. Usually the tertiary alkyl primary amines are monoamines represented by the formula

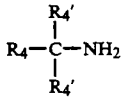

wherein $R_4$ is a hydrocarbyl group containing from 1, or about 4, to about 27, or to about 18 carbon atoms and $R_4'$ is a hydrocarbyl group containing from 1 to about 12 carbon atoms. Such amines are illustrated by tertiary-butyl amine, tertiary-hexyl amine, 1-methyl-1-aminocyclohexane, tertiary-octyl amine, tertiarydecyl amine, tertiary-dodecyl amine, tertiary-tetradecyl amine, tertiary-hexadecyl amine, tertiary-octadecyl amine, tertiary-tetracosanyl amine, tertiary-octacosanyl amine.

Mixtures of amines are also useful for the purposes of this invention. Illustrative of amine mixtures of this type are "Primene 81R" which is a mixture of $C_{11}$–$C_{14}$ tertiary alkyl primary amines and "primene JMT" which is a similar mixture of $C_{18}$–$C_{22}$ tertiary alkyl primary amines (both are available from Rohm and Haas Company). The tertiary alkyl primary amines and methods for their preparation are known to those of ordinary skill in the art. The tertiary alkyl primary amine useful for the purposes of this invention and methods for their preparation are described in U.S. Pat. No. 2,945,749 which is hereby incorporated by reference for its teaching in this regard.

Hydroxylamine

In another embodiment, the amine may be a hydroxylamine. Typically, the hydroxylamines are primary, secondary or tertiary alkanolamines or mixtures thereof. Such amines can be represented by the formulae:

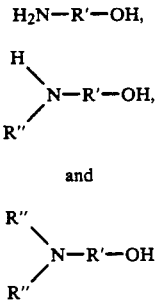

wherein each R″ is independently a hydrocarbyl group of one to about eight carbon atoms or hydroxyhydrocarbyl group of two to about eight carbon atoms, preferably one to about four, and R′ is a divalent hydrocarbyl group of about two to about 18 carbon atoms, preferably two to about four. The group —R′—OH in such formulae represents the hydroxyhydrocarbyl group. R′ can be an acyclic, alilcyclic or aromatic group. Typically, R′ is an acyclic straight or branched alkylene group such as an ethylene, 1,2-propylene, 1,2-butylene, 1,2-octadecylene, etc. group. Where two R″ groups are present in the same molecule they can be joined by a direct carbon-to-carbon bond or through a heteroatom (e.g., oxygen, nitrogen or sulfur) to form a 5-, 6-, 7- or 8-membered ring structure. Examples of such heterocyclic amines include N-(hydroxyl lower alkyl)-morpholines, -thiomorpholines, -piperidines, -oxazolidines, -thiazolidines and the like. Typically, however, each R″ is independently a methyl, ethyl, propyl, butyl, pentyl or hexyl group.

Examples of these alkanolamines include mono-, di-, and triethanolamine, diethylethanolamine, ethylethanolamine, butyldiethanolamine, etc.

The hydroxylamines can also be an ether N-(hydroxyhydrocarbyl)amine. These are hydroxypoly(hydrocarbyloxy) analogs of the above-described hydroxy amines (these analogs also include hydroxy-substituted oxyalkylene analogs). Such N-(hydroxyhydrocarbyl) amines can be conveniently prepared by reaction of epoxides with aforedescribed amines and can be represented by the formulae:

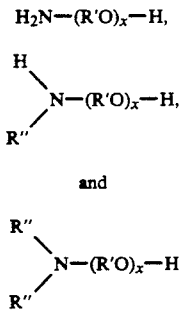

wherein x is a number from about 2 to about 15 and R'' and R' are as described above. R'' may also be a hydroxypoly(hydrocarbyloxy) group.

The amine may also be a polyamine. The polyamine may be aliphatic, cycloaliphatic, heterocyclic or aromatic. Examples of the polyamines include alkylene polyamines, hydroxyl containing polyamines, arylpolyamines, and heterocyclic polyamines.

Alkylenepolyamines

Alkylenepolyamines are represented by the formula

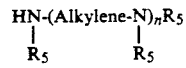

wherein n has an average value between about 1 and about 10, preferably about 2 to about 7, more preferably about 2 to about 5, and the "Alkylene" group has from 1, or about 2 to about 10 carbon atoms, or to about 6, or to about 4. $R_5$ is independently preferably hydrogen; or an aliphatic or hydroxy-substituted aliphatic group of up to about 30 carbon atoms. In one embodiment, when $R_5$ is other than hydrogen, then $R_5$ is defined the same as R''.

Such alkylenepolyamines include methylenepolyamines, ethylenepolyamines, butylenepolyamines, propylenepolyamines, pentylenepolyamines, etc. The higher homologs and related heterocyclic amines such as piperazines and N-amino alkyl-substituted piperazines are also included. Specific examples of such polyamines are ethylene diamine, triethylene tetramine, tris-(2-aminoethyl)amine, propylenediamine, trimethylenediamine, tripropylenetetramine, tetraethylenepentamine, hexaethyleneheptamine, pentaethylenehexamine, etc.

Higher homologs obtained by condensing two or more of the above-noted alkyleneamines are similarly useful as are mixtures of two or more of the aforedescribed polyamines.

Ethylenepolyamines, such as some of those mentioned above, are useful. Such polyamines are described in detail under the heading Ethyleneamines in Kirk Othmer's "Encyclopedia of Chemical Technology", 2d Edition, Vol. 7, pages 22–37, Interscience Publishers, New York (1965). Such polyamines are most conveniently prepared by the reaction of ethylene dichloride with ammonia or by reaction of an ethyleneimine with a ring opening reagent such as water, ammonia, etc. These reaction result in the production of a complex mixture of polyalkylene polyamines including cyclic condensation products such as the aforedescribed piperazines. Ethylenepolyamine mixtures are useful.

Other useful types of polyamine mixtures are those resulting from stripping of the above-described polyamine mixtures to leave as residue what is often termed "polyamine bottoms". In general, alkylenepolyamine bottoms can be characterized as having less than two, usually less than 1% (by weight) material boiling below about 200° C. A typical sample of such ethylenepolyamine bottoms obtained from the Dow Chemical Company of Freeport, Texas designated "E-100" has a specific gravity at 15.6° C. of 1.0168, a percent nitrogen by weight of 33.15 and a viscosity at 40° C. of 121 centistokes. Gas chromatography analysis of such a sample contains about 0.93% "Light Ends" (most probably diethylenetriamine (DETA)), 0.72% triethylenetetraamine (TETA), 21.74% tetraethylenepentamine and 76.61% pentaethylenehexamine and higher (by weight). These alkylenepolyamine bottoms include cyclic condensation products such as piperazine and higher analogs of diethylenetriamine, triethylenetetramine and the like.

Condensed Polyamines

Another useful polyamine is obtained by a condensation reaction between at least one hydroxy compound with at least one polyamine reactant containing at least one primary or secondary amino group. The hydroxy compounds are preferably polyhydric alcohols and amines. The polyhydric alcohols are described above (See alpha, beta-unsaturated ester) and below (See carboxylic ester dispersants).

In one embodiment, the hydroxy compounds are polyhydric amines. Polyhydric amines include any of the above-described monoamines reacted with an alkylene oxide (e.g., ethylene oxide, propylene oxide, butylene oxide, etc.) having two to about 20 carbon atoms, preferably two to about four. Examples of polyhydric amines include tri-(hydroxypropyl)amine, tris-(hydroxymethyl)amino methane, 2-amino-2-methyl-1,3-propanediol, N,N,N',N'-tetrakis(2-hydroxypropyl)ethylenediamine, and N,N,N',N'-tetrakis(2-hydroxyethyl)ethylenediamine, preferably tris(hydroxymethyl-)aminomethane (THAM).

Polyamine reactants, which react with the polyhydric alcohol or amine to form the condensation products or condensed amines, are described above. Preferred polyamine reactants include triethylenetetramine (TETA), tetraethylenepentamine (TEPA), pentaethylenehexamine (PEHA), and mixtures of polyamines such as the above-described "amine bottoms".

The condensation reaction of the polyamine reactant with the hydroxy compound is conducted at an elevated temperature, usually about 60° C. to about 265° C., (preferably about 220° C. to about 250° C.) in the presence of an acid catalyst.

The amine condensates and methods of making the same are described in U.S. Pat. No. 5,053,152 and PCT publication WO 86/05501 which are incorporated by reference for their disclosures to the condensates and methods of making. The preparation of such polyamine condensates may occur as follows: A 4-necked 3-liter round-bottomed flask equipped with glass stirrer, thermowell, subsurface $N_2$ inlet, Dean-Stark trap, and Friedrich condenser is charged with: 1299 grams of HPA Taft Amines (amine bottoms available commercially from Union Carbide Co. with typically 34.1% by weight nitrogen and a nitrogen distribution of 12.3% by weight primary amine, 14.4% by weight secondary amine and 7.4% by weight tertiary amine), and 727 grams of 40% aqueous tris(hydroxymethyl)aminomethane (THAM). This mixture is heated to 60° C. and 23 grams of 85% $H_3PO_4$ is added. The mixture is then heated to 120° C. over 0.6 hour. With $N_2$ sweeping, the mixture is then heated to 150° C. over 1.25 hour, then to 235° C. over 1 hour more, then held at 230°-235° C. for 5 hours, then heated to 240° C. over 0.75 hour, and then held at 240°-245° C. for 5 hours. The product is cooled to 150° C. and filtered with a diatomaceous earth filter aid. Yield: 84% (1221 grams).

Hydroxyl Polyamines

In another embodiment, the polyamines are hydroxyl polyamines. Hydroxyl polyamine analogs of hydroxy monoamines, particularly alkoxylated alkylenepolyamines (e.g., N,N(diethanol)ethylenediamine) can also be used. Such polyamines can be made by reacting the above-described alkylene amines with one or more of the above-described alkylene oxides. Similar alkylene oxide-alkanolamine reaction products can also be used such as the products made by reacting the aforedescribed primary, secondary or tertiary alkanolamines with ethylene, propylene or higher epoxides in a 1.1 to 1.2 molar ratio. Reactant ratios and temperatures for carrying out such reactions are known to those skilled in the art.

Specific examples of alkoxylated alkylenepolyamines include N-(2-hydroxyethyl)ethylenediamine,N,N'-bis(2-hydroxyethyl)ethylenediamine,1-(2-hydroxyethyl)-piperazine,mono(2-hydroxypropyl)-tetraethylenepentamine,N-(3-hydroxybutyl)-tetramethylenediamine, etc. Higher homologs obtained by condensation of the above-illustrated hydroxy-containing polyamines through amino groups or through hydroxy groups are likewise useful. Condensation through amino groups results in a higher amine accompanied by removal of ammonia while condensation through the hydroxy groups results in products containing ether linkages accompanied by removal of water. Mixtures of two or more of any of the aforesaid polyamines are also useful.

Heterocyclic Amines

In another embodiment, the polyamine may be a heterocyclic mono-or polyamine. The heterocyclic amines include aziridines, azetidines, azolidines, tetra- and dihydropyridines, piperidines, imidazoles, di- and tetrahydroimidazoles, piperazines, purines, morpholines, thiomorpholines, N-aminoalkylmorpholines, N-aminoalkylthiomorpholines, N-aminoalkylpiperazines, N,N'-di-aminoalkylpiperazines, azepines, azocines, azonines, azecines and tetra-, di- and perhydro derivatives of each of the above and mixtures of two or more of these heterocyclic amines. Preferred heterocyclic amines are the saturated 5- and 6-membered heterocyclic amines containing only nitrogen, oxygen and/or sulfur in the hetero ring, especially the piperidines, piperazines, thiamorpholines, morpholines, pyrrolidines, and the like. Piperidine, aminoalkyl-substituted piperidines, piperazine, aminoalkyl-substituted piperazines, morpholine, aminoalkyl-substituted morpholines, pyrrolidine, and aminoalkyl-substituted pyrrolidines, are especially preferred. Usually the aminoalkyl substituents are substituted on a nitrogen atom forming part of the hetero ring. Specific examples of such heterocyclic amines include N-aminopropylmorpholine, N-aminoethylpiperazine, and N,N'diaminoethylpiperazine. Hydroxy heterocyclic amines are also useful, and include N-hydroxyethylpiperazine, and the like.

Polyalkylene-Substituted Amines

In another embodiment, the amine is a polyalkene-substituted amine. These polyalkene-substituted amines are well known to those skilled in the art and have been referred to as hydrocarbyl amines. These amines are disclosed in U.S. Pat. Nos. 3,275,554; 3,438,757; 3,454,555; 3,565,804; 3,755,433; and 3,822,289. These patents are hereby incorporated by reference for their disclosure of hydrocarbyl amines and methods of making the same.

Typically, polyalkene-substituted amines are prepared by reacting olefins and olefin polymers (polyalkenes) or their chlorinated analogue with amines (mono-or polyamines). The amines may be any of the amines described above. In one embodiment, the amines are polyamines, and more particularly, the alkylenepolyamines described above. Examples of these compounds include poly(propylene)amine; N,N-dimethyl-N-poly(ethylene/propylene)amine, (50:50 mole ratio of monomers); poly(butene)amine; N,N-di(-hydroxyethyl)-N-poly(butene)amine; N-(2-hydroxypropyl)-N-polybutene amine; N-polybutene-aniline; N-polybutenemorpholine; N-poly(butene)ethylenediamine; N-poly(propylene)trimethylenediamine; N-poly(-butene)diethylenetriamine; N',N'-poly(butene)tetraethylenepentamine; N,N-dimethyl-N'-poly(propylene)-1,3-propylenediamine and the like.

The polyalkene is characterized as containing from at least about 8 carbon atoms, or about 30, or about 35 up to about 300, or to about 200, or to about 100 carbon atoms. In one embodiment, the polyalkene is characterized by an $\overline{M}n$ (number average molecular weight) of at least about 500. Generally, the polyalkene is characterized by an $\overline{M}n$ of about 500, or about 800 up to about 5000, or to about 2500. In another embodiment, $\overline{M}n$ varies between about 500 or about 800 to about 1200, or to about 1300.

The polyalkenes include homopolymers and interpolymers of polymerizable olefin monomers of 2 to about 16, or to about 6, or to about 4 carbon atoms. The olefins may be monoolefins such as ethylene, propylene, 1-butene, isobutene, and 1-octene; or a polyolefinic monomer, preferably diolefinic monomer, such 1,3-butadiene and isoprene. Preferably, the interpolymer is a homopolymer. An example of a preferred homopolymer is a polybutene, preferably a polybutene in which about 50% of the polymer is derived from isobutylene. The polyalkenes are prepared by conventional procedures.

Acylated Nitrogen Compounds

The amine may also be an acylated nitrogen-containing compound. The acylated nitrogen-containing compounds include reaction products of hydrocarbyl-substituted carboxylic acid or derivatives thereof. These compounds include imides, amides, amidic acid or salts, heterocycles (imidazolines, oxazolines, etc.), and mixtures thereof. In one embodiment, these compounds are useful as dispersants in lubricating compositions and have been referred to as nitrogen-containing carboxylic dispersants. The amines are described above, typically the amines are polyamines, preferably the amines are alkylenepolyamines (e.g., ethylenepolyamines), amine bottoms or amine condensates.

The hydrocarbyl-substituted carboxylic acylating agent may be a monocarboxylic or a polycarboxylic acid or derivative. Polycarboxylic acylating agents generally are preferred. The carboxylic acylating agents include halides, esters, anhydrides, etc., preferably acid, esters or anhydrides, more preferably anhydrides. Preferably the carboxylic acylating agent is a succinic acid or derivative thereof. The hydrocarbyl-substituted carboxylic acylating agent have a hydrocarbyl group derived from a polyalkene. The polyalkenes are described above.

In one embodiment, the hydrocarbyl group is derived from polyalkenes having an $\overline{M}n$ of at least about 1300 or about 1500 up to about 5000, or to about 3000, or up to about 2500, or about 2000, and the $\overline{M}w/\overline{M}n$ is from about 1.5, or about 1.8, or about 2.5 up to about 4, or to about 3.6, or to about 3.2.

The hydrocarbyl-substituted carboxylic acylating agents are prepared by a reaction of one or more polyalkenes with one or more unsaturated carboxylic reagent. The unsaturated carboxylic reagent generally contains an alpha-beta olefinic unsaturation. These unsaturated carboxylic reagents may be either monobasic or polybasic in nature. The unsaturated carboxylic reagents are described above and are referred to as alpha, beta-unsaturated carboxylic acylating agents. Generally, the unsaturated carboxylic reagents are maleic anhydrides or maleic or fumaric acids or esters, preferably, maleic acids or anhydrides, more preferably maleic anhydrides.

The polyalkene may be reacted with the carboxylic reagent such that there is at least one mole of reagent for each mole of polyalkene. Preferably, an excess of reagent is used. This excess is generally between about 5% to about 25%.

In another embodiment, the hydrocarbyl-substituted carboxylic acids or derivatives are prepared by reacting the above described polyalkene with an excess of maleic anhydride to provide substituted succinic acylating agents wherein the number of succinic groups for each equivalent weight of substituent group is at least 1.3. The maximum number will not exceed 4.5. A suitable range is from about 1.4 to 3.5 and more specifically from about 1.4 to about 2.5 succinic groups per equivalent weight of substituent groups. In this embodiment, the polyalkene has an $\overline{M}n$ from about 1300 to about 5000 and a $\overline{M}w/\overline{M}n$ of at least 1.5, as described above, A more preferred range for $\overline{M}n$ is from about 1500 to about 2800, and a most preferred range is from about 1500 to about 2400. The preparation and use of substituted succinic acids or derivatives thereof wherein the substituent is derived from such polyolefins are described in U.S. Pat. No. 4,234,435, the disclosure of which is hereby incorporated by reference.

The conditions, i.e., temperature, agitation, solvents, and the like, for reacting an acid reactant with a polyalkene, are known to those in the art. Examples of patents describing various procedures for preparing useful acylating agents include U.S. Pat. Nos. 3,215,707 (Rense); 3,219,666 (Norman et al); 3,231,587 (Rense); 3,912,764 (Palmer); 4,110,349 (Cohen); and 4,234,435 (Meinhardt et al); and U.K. 1,440,219. The disclosures of these patents are hereby incorporated by reference.

The following examples relate to the reaction products and salts of the reaction products of the present invention. Unless otherwise indicated, in the following examples as well as elsewhere in the specification and claims, parts and percentages are by weight, temperature is degrees celsius, and pressure is atmospheric pressure.

EXAMPLE 1

A 3-liter flask, fitted with a gas sparge, addition funnel, reflux condenser, stirrer, and external heater is charged with 2,5-dimercapto-1,3,4-thiadiazole (600 grams, 4.0 moles) and 600 ml of toluene. A nitrogen gas flow is introduced to the vessel, and the mixture is heated to about 83° C., with stirring. A 732 gram (4.0 moles) charge of 2-ethylhexyl acrylate is added over about 45 minutes through the addition funnel, causing the flask contents to heat to about 105° C. A temperature of 85° C. is maintained for about 1 hour after all of the acrylate has been added.

Product is recovered by heating to about 115° C. under a vacuum (about 40 mm mercury) and clarifying by filtration through cloth-supported diatomaceous earth. The product has 7.9% nitrogen, 27.4% sulfur, and a neutralization acid number of 170.6 (phenolphthalein) and 4.7 (bromphenol blue).

EXAMPLE 2

A 1-liter flask is charged with 250 grams (0.75 moles) of the product from the preceding example, 137 grams (0.75 moles) of 2-ethylhexyl acrylate, and 0.4 grams of triethylamine. The mixture is stirred and heated under nitrogen to 115° C. and the temperature is maintained for about 5.5 hours.

Product is recovered by heating to about 130° C. under a vacuum (28 mm mercury) and clarifying as in the preceding example. The product has 4.1% nitrogen, 14.6% sulfur, and a neutralization acid number of 2.1 (phenolphthalein) and 0.3 (bromphenol blue).

EXAMPLE 3

A reaction vessel is charged with 333 grams (1.0 mole) of the product from Example 1. A charge of 10-grams of the zinc oxide is added to the flask, the mixture is heated to about 100° C. under a vacuum (about 30 mm mercury), and stirring is continued for about 1 to 1.5 hours. Then, an additional 10 grams of zinc oxide are added, and the mixture is stirred for 1 hour and 10 minutes. An additional 10 grams of zinc oxide is then added to the vessel and the reactions continued for 1 hour and 15 minutes. A additional charge of 11 grams of zinc oxide is added to the reaction, and the reaction mixture is stirred for 1 hour. The reaction mixture is then heated to 110° C. and the temperature is maintained for 1 hour. A total of 41 grams (0.5 mole) of zinc oxide is added over 5.5 hours to the reaction vessel.

Product is recovered by clarifying through cloth-supported diatomaceous earth. The product has 7.24% nitrogen, 24.9% sulfur, 9.1% zinc, and a neutralization acid number of 144 (phenolphthalein) and 0.4 (bromphenol blue).

EXAMPLE 4

Using the general procedure of Example 1, 387 grams (3.0 moles) of n-butyl acrylate and 450 grams (3.0 moles) of 2,5-dimercapto-1,3,4-thiadiazole are reacted at about 80° C. for about 2.5 hours, in 400 ml of toluene. The liquid product is recovered in a manner similar to that described in Example 3. The product has 9.8% nitrogen, 32.9% sulfur, and a neutralization acid number of 195 (phenolphthalein) and 3.6 (bromphenol blue).

EXAMPLE 5

Using the general procedure of Example 2,201 grams (0.7 moles) of the product of Example 4 are reacted with 108 grams (0.84 moles) of n-butyl acrylate, in the presence of 0.3 grams of tributylamine, over a period of about 35 hours.

After heating to about 115° C. under a vacuum (20 mm mercury), the product is clarified by filtration through cloth-supported diatomaceous earth. The product has 6.8% nitrogen, 23.8% sulfur, and a neutralization acid number of 15.5 (phenolphthalein) and 0.5 (bromphenol blue).

EXAMPLE 6

Using the general procedure of Example 5, 309 grams (1.1 moles) of the product from Example 4 are reacted with 46 grams (0.56 mole) of zinc oxide. The liquid product is recovered in a manner similar to that described in Example 5. The product has 9.1% nitrogen, 31.2% sulfur, 6.9% zinc, and a neutralization acid number of 172 (phenolphthalein) and 5.2 (bromphenol blue).

EXAMPLE 7

The procedure of Example 1 is repeated, except that the product recovery step is preceded by an addition of 740 grams (4.0 moles) of Armeen 12D (commercial distilled n-dodecylamine from Akzo Chemie) at about 85° C., over about 1 hour, After stirring for another hour, the reaction mixture is stripped at 85° C. and 20 mm Hg. The residue is filtered through diatomaceous earth. The filtrate is the desired product. The product is an amber liquid having 8.1% nitrogen, 27.4% sulfur, and a neutralization acid number of 156 (phenolphthalein) and 6.1 (bromphenol blue).

EXAMPLE 8

The procedure of the preceding example is repeated, except that the Armeen 12D is replaced by 784 grams (4.0 moles) of PRIMENE® 81-R, a product of Rohm and Haas Company, Philadelphia, Pennsylvania U.S.A. which is a mixed t-alkyl primary amine, having $C_{12-14}$ alkyl groups and a molecular weight principally in the range 185 to 215. The product has 7.89% nitrogen, 19.6% sulfur, a neutralization acid number of 113 (phenolphthalein) and a neutralization base number of 59 (bromphenol blue).

EXAMPLE 9

The procedure of the preceding example is repeated, except that the PRIMENE® 81-R is replaced by 292 grams (4.0 moles) of n-butyl amine. The product has 9.8% nitrogen, 21.4% sulfur, a neutralization acid number of 198 (phenolphthalein) and a neutralization base number of 39 (bromphenol blue).

EXAMPLE 10

A reaction vessel is charged with 75 parts (1.04 mole) of acrylic acid, 257 parts (1.0 mole) of dodecylthioethanol and 80 parts of toluene, and the mixture is heated to reflux with rapid stirring, using a slow nitrogen sparge. Water of condensation is removed by azeotropic distillation over a 12-hour period. The reaction mixture is vacuum-distilled to give a major distilling fraction at 180°-194° C.0.2 mm Hg. The fraction has 10.73% sulfur.

A reaction vessel, equipped with mechanical stirrer, reflux condenser and addition funnel is charged with 200 parts of isopropyl alcohol and 75 parts (0.5 mole) of 2,5-dimercapto-1,3,4-thiadiazole. The stirred mixture is heated to reflux (85° C.) with stirring under a slow nitrogen sparge, and a charge of 165 grams (0.5 mole) of the dodecylthioethyl-acrylate prepared above is added at a constant rate over 0.5 hour. The mixture is stirred at 85° C. for an additional 0.5 hour. Isopropyl alcohol is removed at 129° C./15 mm Hg. Diatomaceous earth (5 parts) is stirred into the stripping residue, and the mixture is filtered at 80° C. through cloth on a Buchner funnel with gentle vacuum, to give 230 grams of a viscous yellow liquid adduct having a 124 acid neutralization number (phenolphthalein).

EXAMPLE 11

A reaction vessel is charged with 514 parts (2.0 moles) of dodecylthioethanol, 98 parts (1 mole) of maleic anhydride, and 100 parts of toluene. The mixture is stirred rapidly while heating to reflux, using a slow nitrogen sparge. Toluene is removed slowly, while allowing the temperature to rise to 156° C. over a period of 1.5 hours. Water is collected in a separator trap at that temperature over the next 8 hours. Infrared examination at intervals showed a progressive decrease in free carboxylic acid, and a sharpening of the ester carbonyl absorption. The mixture is stripped under vacuum at 215° C./0.2 mm Hg., to give a clear yellow oil which solidified to a light tan wax at room temperature. The residue contains 11.5% sulfur.

A reaction vessel is charged with 75 parts (0.5 mole) of 2,5-dimercapto-1,3,4-thiadiazole and 200 parts of isopropyl alcohol, and is stirred while heating to 82° C. Di-(dodecylthioethyl) maleate, prepared above, (300 parts, 0.5 mole) is added at a steady rate over a period of 2 hours at that temperature, with rapid stirring. The mixture is stirred at 82° C. for an additional 2 hours, and then isopropyl alcohol is removed under vacuum (115° C./0.13 mm). The residue is treated with 6 parts of diatomaceous earth and filtered through cloth on a Buchner funnel, to give 374 parts of yellow-amber viscous liquid. The product contains 21.70% sulfur, and 3.58% nitrogen.

EXAMPLE 12

The reaction vessel is charged with $C_{16-18}$ acrylate (620 grams, 2 moles) and 2,5-dimercapto-1,3,4-thiadiazole (300 grams, 2 moles). The mixture is stirred and heated to 60° C. wherein the temperature increases exothermically to 110° C. The mixture is cooled to 70° C. and vacuum stripped to 110° C. and 140 mm Hg. The residue is filtered through diatomaceous earth supported by cloth. The filtrate is the desired product and has 17.65% sulfur, a 116.4 neutralization acid number (phenolphthalein), and a 18 neutralization acid number (bromphenol blue).

EXAMPLE 13

The reaction vessel is charged with 130 grams (1 mole) of itaconic acid, 420 grams (2 moles) of NEODOL® 45 (a mixture of linear and branched primary alcohols having essentially 14 and 15 carbon atoms (available commercially from Shell Chemical Company), 4-methoxyphenol (0.4 grams), and 300 grams of toluene. The mixture is stirred and held at toluene reflux with removal of water until the neutralization acid number of the mixture to phenolphthalein was less than 5. The mixture is cooled to 80° C., where 2,5-dimercapto-1,3,4-thiadiazole (150 grams, 1 mole) is added to the reaction mixture. The mixture is heated to 120° C. and held for 4 hours.

The product is recovered by vacuum stripping the reaction mixture to 150° C. and 100 mm of mercury, and filtering the residue through diatomaceous earth supported by a cloth pad. The filtrate has an 80 neutralization acid number (phenolphthalein) and an 11 neutralization acid number (bromphenol blue).

EXAMPLE 14

The reaction vessel is charged with 100 ml of toluene, 1,350 grams (9 moles) of 2,5-dimercapto-1,3,4-thiadiazole, 648 grams (9 moles) of acrylic acid and 3 grams of paratoluenesulfonic acid. The mixture is stirred and heated to 110° C. The temperature is maintained at 110° C. for 2 hours, while 9 ml of water is removed. The mixture is cooled to 80° C., where 1,800 grams (9 moles) of $C_{12-14}$ alcohol (a mixture of linear alcohols having 12 and 14 carbon atoms available commercially from Vista Chemical Company) is added over 15 minutes. The reaction mixture is heated to 115° C.–120° C. and the temperature is maintained for 1 hour. The water is removed by distillation (125 ml). The reaction is cooled to 80° C. and vacuum stripped to 80° C. and 30 mm Hg. The residue is filtered through cloth and diatomaceous earth. The filtrate has 6.5% nitrogen, 22.2% sulfur, a 127.5 neutralization acid number (phenolphthalein), and a 10.5 neutralization acid number (bromphenol blue).

Lubricants

As previously indicated, the reaction products (i) and their salts (ii) are useful as additives for lubricants in which they can function primarily as antiwear, antiweld, extreme pressure, anticorrosion, antioxidation and/or friction modifying agents. They can be employed in a variety of lubricants based on diverse oils of lubricating viscosity, including natural and synthetic lubricating oils and mixtures thereof. These lubricants include crankcase lubricating oils for spark-ignited and compression-ignited internal combustion engines, including automobile and truck engines, two-cycle engines, aviation piston engines, marine and railroad diesel engines, and the like. They can also be used in gas engines, stationary power engines and turbines and the like. Automatic transmission fluids, transaxle lubricants, gear lubricants, tractor lubricants, metal-working lubricants, hydraulic fluids and other lubricating oil and grease compositions can also benefit from the incorporation therein of the compositions of the present invention.

The reaction products and salts of the reaction products of the present invention may be used in lubricants or in concentrates. The concentrate contains the reaction products and their salts alone or in combination with other components used in preparing fully formulated lubricants. The concentrate also contains a substantially inert organic diluent, which includes kerosene, mineral distillates, or one or more of the oils of lubricating viscosity discussed below. In one embodiment, the concentrates contain from 0.01%, or about 0.1%, or about 1% to about 70% or about 80%, even up to about 90% by weight of the compositions of the present invention. These compositions may be present in a final product, blend or concentrate in any amount effective to act as an antiwear agent, but is preferably present in the lubricating composition in an amount of from about 0.01%, or about 0.1%, or about 0.5%, or about 1% to about 10%, or to about 5% by weight. In one embodiment, when the compositions of the present invention are used in oils, such as gear oils, they are preferably present in an amount from about 0.1%, or about 0.5%, or about 1%, up to about 8%, or to 5%, or to about 3% by weight of the lubricating composition.

The oil which is utilized in the preparation of the lubricants of the invention may be based on natural oils, synthetic oils, or mixtures thereof. Natural oils include animal oils and vegetable oils (e.g., castor oil, lard oil) as well as mineral lubricating oils such as liquid petroleum oils and solvent treated or acid treated mineral lubricating oils of the paraffinic, naphthenic or mixed paraffinic-naphthenic types. Oils of lubricating viscosity derived from coal or shale are also useful. Synthetic lubricating oils include hydrocarbon oils and halo-substituted hydrocarbon oils such as polymerized and interpolymerized olefins (e.g., polybutylenes, polypropylenes, propylene-isobutylene copolymers, chlorinated polybutylenes, etc.), poly(1-hexenes), poly(1-octenes), poly(1-decenes), etc. and mixtures thereof, alkylbenzenes (e.g., dodecylbenzenes, tetradecylbenzenes, dinonylbenzenes, di-(2-ethylhexyl)-benzenes, etc.), polyphenyls (e.g., biphenyls, terphenyls, alkylated polyphenyls, etc.), alkylated diphenyl ethers and alkylated diphenyl sulfides and the derivatives, analogs and homologs thereof and the like.

Alkylene oxide polymers and interpolymers and derivatives thereof where the terminal hydroxyl groups have been modified by esterification, etherification, etc., constitute another class of known synthetic lubricating oils that can be used. These are exemplified by the oils prepared through polymerization of ethylene oxide, propylene oxide, the alkyl and aryl ethers of these polyoxyalkylene polymers (e.g., polyoxypropylene glycol methyl ether having an average molecular weight of about 1000, diphenyl ether of polyethylene glycol having a molecular weight of about 500–1000, diethyl ether of polypropylene glycol having a molecular weight of about 1000–1500, etc.) or mono- and polycarboxylic esters thereof, for example, the acetic acid esters, mixed $C_3$–$C_8$ fatty acid esters, or the $C_{13}$ Oxo acid diester of tetraethylene glycol, or higher $C_{12-18}$ carboxylic diesters of 400–1200 molecular weight polyethylene glycol.

Another suitable class of synthetic lubricating oils that can be used comprises the esters of dicarboxylic acids (e.g., phthalic acid, succinic acid, alkylsuccinic acids, alkenylsuccinic acids, maleic acid, azelaic acid, suberic acid, sebacic acid, fumaric acid, adipic acid, linoleic acid dimer, malonic acid, alkylmalonic acids, etc.) with a variety of alcohols (e.g., butyl alcohol, hexyl alcohol, dodecyl alcohol, 2-ethylhexyl alcohol, ethylene glycol, diethylene glycol monoether, propylene glycol, etc.) Specific examples of these esters include dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, the complex ester formed by reacting one mole of sebacic acid with two moles of tetraethylene glycol and two moles of 2-ethylhexanoic acid and the like.

Esters useful as synthetic oils also include those made from $C_5$ to $C_{22}$ monocarboxylic acids and polyols and polyol ethers such as neopentyl glycol, trimethylolpropane, pentaerythritol, dipentaerythritol, tripentaerythritol, etc.

Silicon-based oils such as the polyalkyl-, polyaryl-, polyalkoxy-, or polyaryloxy-siloxane oils and silicate oils comprise another useful class of synthetic lubricants (e.g., tetraethyl silicate, tetraisopropyl silicate, tetra-(2-ethylhexyl) silicate, tetra-(4-methylhexyl) silicate, tetra-(p-tert-butylphenyl) silicate, hexyl-(4-methyl-2-pentoxy)disiloxane, poly(methyl)siloxanes, poly-(methylphenyl)siloxanes, etc.). Other synthetic lubricating oils include liquid esters of phosphorus-containing acids (e.g., tricresyl phosphate, trioctyl phosphate, diethyl ester of decanephosphonic acid, etc.), polymeric tetrahydrofurans and the like.

Unrefined, refined and rerefined oils, either natural or synthetic (as well as mixtures of two or more of any of these) of the type disclosed hereinabove can be used in the concentrates of the present invention. Unrefined oils are those obtained directly from a natural or synthetic source without further purification treatment. For example, a shale oil obtained directly from retorting operations, a petroleum oil obtained directly from primary distillation or ester oil obtained directly from an esterification process and used without further treatment would be an unrefined oil. Refined oils are similar to the unrefined oils except they have been further treated in one or more purification steps to improve one or more properties. Many such purification techniques are known to those skilled in the art such as solvent extraction, hydrotreating, secondary distillation, acid or base extraction, filtration, percolation, etc. Rerefined oils are obtained by processes similar to those used to obtain refined oils applied to refined oils which have been already used in service. Such rerefined oils are also known as reclaimed, recycled or reprocessed oils and often are additionally processed by techniques directed to removal of spent additives, oil contaminants such as water and fuel, and oil breakdown products.

The oil of lubricating viscosity is generally present in a major amount (i.e. an amount greater than 50% by weight). Preferably, the oil of lubricating viscosity is present in an amount greater than about 60%, preferably 70%, more preferably 80% by weight. In one embodiment, the oil of lubricating viscosity may be present in an amount from about 90% by weight.

Specific examples of the oils of lubricating viscosity are described in U.S. Pat. No. 4,326,972 and European Patent Publication 107,282, both herein incorporated by reference for their disclosures relating to lubricating oils. A basic, brief description of lubricant base oils appears in an article by D. V. Brock, "Lubricant Base Oils", *Lubricant Engineering*, Volume 43, pages 184–185, March, 1987. This article is herein incorporated by reference for its disclosures relating to lubricating oils. A description of oils of lubricating viscosity occurs in U.S. Pat. No. 4,582,618 (column 2, line 37 through column 3, line 63, inclusive), herein incorporated by reference for its disclosure to oils of lubricating viscosity.

In one embodiment, the oil of lubricating viscosity or a mixture of lubricating oils are selected to provide lubricating compositions with a kinematic viscosity of at least about 3.5, or about 4.0 Cst at 100° C. Preferably, the lubricating compositions have an SAE gear viscosity number of at least about SAE 65, more preferably at least about SAE 75. The lubricating composition may also have a so-called multigrade rating such as SAE 75W-80, 75W-90, 75W-90, or 80W-90. Multigrade lubricants may include a viscosity improver which is formulated with the oil of lubricating viscosity to provide the above lubricant grades. Useful viscosity improvers include polyolefins, such as ethylene-propylene copolymers, or polybutylene rubbers, including hydrogenated rubbers, such as styrene-butadiene or styrene-isoprene rubbers; or polyacrylates, including polymethacrylates. Preferably the viscosity improver is a polyolefin or polymethacrylate, more preferably polymethacrylate. Viscosity improvers available commercially include Acryloid TM viscosity improvers available from Rohm & Haas; Shellvis TM rubbers available from Shell Chemical; and Lubrizol 3174 available from The Lubrizol Corporation.

In another embodiment, the oil of lubricating viscosity is selected to provide lubricating compositions for crankcase applications, such as for gasoline and diesel engines. Typically, the lubricating compositions are selected to provide an SAE crankcase viscosity number of 10W, 20W, or 30W lubricants. The lubricating composition may also have a so called multi-grade rating such as SAE 5W-30, 10W-30, 10W-40, 20W-50, etc. As described above, multi-grade lubricants include a viscosity improver which is formulated with the oil of lubricating viscosity to provide the above lubricant grades.

In one embodiment, the reaction products are used in low or no phosphorus lubricants. Low or no phosphorus lubricants generally contain less than 0.1%, or less than 0.05%, or less than 0.02% phosphorus.

In one embodiment, the reaction products and salts thereof of the present invention are used in lubricating compositions together with a metal dithiophosphate or a sulfurized organic composition. Lubricating compositions containing these combinations of these materials have improved wear and oxidation properties.

Metal Dithiophosphate

The metal dithiophosphate may be represented by the formula

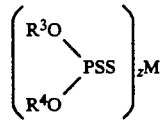

wherein $R^3$ and $R^4$ are each independently hydrocarbyl groups containing from 3 to about 30, or to about 18, or to about 12, or even to about 8 carbon atoms. M is a metal, and z is an integer equal to the valence of M.

The hydrocarbyl groups $R^3$ and $R^4$ in the dithiophosphate may each independently be alkyl, cycloalkyl, aralkyl or alkaryl groups. Illustrative alkyl groups include isopropyl, isobutyl, n-butyl, sec-butyl, the various amyl groups, n-hexyl, methylisobutyl carbinyl, heptyl, 2-ethylhexyl, isooctyl, nonyl, behenyl, decyl, dodecyl, tridecyl, etc. Illustrative lower alkylphenyl groups include butylphenyl, amylphenyl, heptylphenyl, etc. Cycloalkyl groups likewise are useful and these include chiefly cyclohexyl and the lower alkylcyclohexyl radicals. Many substituted hydrocarbon groups may also be used, e.g., chloropentyl, dichlorophenyl, and dichlorodecyl.

The phosphorodithioic acids from which the metal salts are prepared are known. Examples of dihydrocarbyl phosphorodithioic acids and metal salts, and processes for preparing such acids and salts are found in, for example, U.S. Pat. Nos. 4,263,150; 4,289,635;

4,308,154; and 4,417,990. These patents are hereby incorporated by reference for such disclosures.

The phosphorodithioic acids are prepared by the reaction of phosphorus pentasulfide with an alcohol or phenol or mixtures of alcohols. The reaction involves four moles of the alcohol or phenol per mole of phosphorus pentasulfide, and may be carried out within the temperature range from about 50° C. to about 200° C. The preparation of the metal salt of this acid may be effected by reaction with metal oxide. Simply mixing and heating these two reactants is sufficient to cause the reaction to take place and the resulting product is sufficiently pure for the purposes of this invention.

The metal salts of dihydrocarbyl dithiophosphates which are useful in this invention include those salts containing Group I metals, Group II metals, aluminum, lead, tin, molybdenum, manganese, cobalt, and nickel. Group I and Group II (including Ia, Ib, IIa and IIb as defined in the Periodic Table of the Elements in the Merck Index, 9th Edition (1976)). The Group II metals, aluminum, tin, iron, cobalt, lead, molybdenum, manganese, nickel and copper are among the preferred metals with zinc being especially useful. Examples of metal compounds which may be reacted with the dithiophosphoric acid include lithium oxide, lithium hydroxide, sodium hydroxide, sodium carbonate, potassium hydroxide, potassium carbonate, silver oxide, magnesium oxide, magnesium hydroxide, calcium oxide, zinc hydroxide, zinc oxide, strontium hydroxide, cadmium oxide, cadmium hydroxide, barium oxide, aluminum oxide, iron carbonate, copper hydroxide, copper oxide, lead hydroxide, tin butylate, cobalt hydroxide, nickel hydroxide, nickel carbonate, etc.

In one embodiment, the alkyl groups $R^3$ and $R^4$ are derived from secondary alcohols such as isopropyl alcohol, secondary butyl alcohol, 2-pentanol, 2-methyl-4-pentanol, 2-hexanol, 3-hexanol, etc.

Useful metal phosphorodithioates can be prepared from phosphorodithioic acids which in turn are prepared by the reaction of phosphorus pentasulfide with mixtures of alcohols. The mixtures of alcohols may be mixtures of different primary alcohols, mixtures of different secondary alcohols or mixtures of primary and secondary alcohols. Examples of useful mixtures include: 1-butanol and 1-octanol; 1-pentanol and 2-ethyl-1-hexanol; isobutanol and n-hexanol; isobutanol and isoamyl alcohol; 2-propanol and 2-methyl-4-pentanol; isopropanol and sec-butyl alcohol; isopropanol and isooctyl alcohol; etc. Useful alcohol mixtures are mixtures of secondary alcohols containing at least about 20 mole percent of isopropyl alcohol, and in one embodiment, at least 40 mole percent of isopropyl alcohol. Examples of metal dithiophosphates include zinc isopropyl, methyl amyl dithiophosphate, zinc isopropyl isooctyl dithiophosphate, barium di(nonyl) dithiophosphate, zinc di(cyclohexyl) dithiophosphate, zinc di(isobutyl) dithiophosphate, calcium di(hexyl) dithiophosphate, zinc isobutyl isoamyl dithiophosphate, and zinc isopropyl secondary-butyl dithiophosphate.

Another class of the phosphorodithioate additives contemplated as useful in the lubricating compositions of the invention comprises metal salts of (a) at least one phosphorodithioic acid as defined above and (b) at least one aliphatic or alicyclic carboxylic acid. The carboxylic acid may be a monocarboxylic or polycarboxylic acid, usually containing from 1 to about 3, preferably one carboxylic acid groups. It may contain from about 2, to about 5 to about 40, or to about 30, or to about 20, or to about 12 carbon atoms. The preferred carboxylic acids are those having the formula $R^5COOH$, wherein $R^5$ is an aliphatic or alicyclic hydrocarbyl group preferably free from acetylenic unsaturation, $R^5$ generally contains from about 2, or about 4 up to about 40, or to about 30, or to about 20, or to about 12 carbon atoms. In one embodiment, $R^5$ contains from 4, or about 6 up to about 12, or to about 8 carbon atoms. In one embodiment, $R^5$ is an alkyl group. Suitable acids include the butanoic, pentanoic, hexanoic, octanoic, nonanoic, decanoic, dodecanoic, octodecanoic and eicosanoic acids, as well as olefinic acids such as oleic, linoleic, and linolenic acids and linoleic acid dimer. For the most part, $R^5$ is a saturated aliphatic group and especially a branched alkyl group such as the isopropyl or 3-heptyl group. Illustrative polycarboxylic acids are succinic, alkyl- and alkenylsuccinic, adipic, sebacic and citric acids. A preferred carboxylic acid is 2-ethylhexanoic acid.

The metal salts may be prepared by merely blending a metal salt of a phosphorodithioic acid with a metal salt of a carboxylic acid in the desired ratio. The ratio of equivalents of phosphorodithioic to carboxylic acid salts is between about 0.5:1 to about 400:1. Preferably, the ratio is between about 0.5:1 and about 200:1. Advantageously, the ratio can be from about 0.5:1 to about 100:1, or to about 50:1, or to about 20:1. Further, the ratio can be from about 0.5:1 to about 4.5:1, preferably about 2.5:1 to about 4.25:1. For this purpose, the equivalent weight of a phosphorodithioic acid is its molecular weight divided by the number of -PSSH groups therein, and that of a carboxylic acid is its molecular weight divided by the number of carboxy groups therein.

A second and preferred method for preparing the metal salts useful in this invention is to prepare a mixture of the acids in the desired ratio and to react the acid mixture with one of the above described metal compounds. When this method of preparation is used, it is frequently possible to prepare a salt containing an excess of metal with respect to the number of equivalents of acid present; thus, metal salts containing as many as 2 equivalents and especially up to about 1.5 equivalents of metal per equivalent of acid may be prepared. The equivalent of a metal for this purpose is its atomic weight divided by its valence.

The temperature at which the metal salts are prepared is generally between about 30° C. and about 150° C., preferably up to about 125° C. If the metal salts are prepared by neutralization of a mixture of acids with a metal base, it is preferred to employ temperatures above about 50° C. and especially above about 75° C. It is frequently advantageous to conduct the reaction in the presence of a substantially inert, normally liquid organic diluent such as naphtha, benzene, xylene, mineral oil or the like. If the diluent is mineral oil or is physically and chemically similar to mineral oil, it frequently need not be removed before using the mixed metal salt as an additive for lubricants or functional fluids.

U.S. Pat. Nos. 4,308,154 and 4,417,990 describe procedures for preparing these metal salts and disclose a number of examples of such metal salts. Such disclosures of these patents are hereby incorporated by reference.

Generally, the oil compositions of the present invention will contain varying amounts of one or more of the above-identified metal dithiophosphates such as from about 0.1%, or about 0.5%, or about 1% to about 10%, or to about 7%, or to about 5% by weight based on the weight of the total oil composition.

Sulfurized Organic Compounds

The sulfurized organic compositions include mono- or polysulfide compositions or mixtures thereof. The sulfurized organic compositions are generally characterized as having sulfide linkages containing an average from 1, or about 2, or about 3 up to about 10, or to about 8, or to about 4 sulfur atoms. In one embodiment, the sulfurized organic compositions are polysulfide compositions generally characterized as di-, tri- or tetrasulfide compositions. Generally, the sulfurized organic compositions are present in an amount from about 0.1%, or about 0.5% or about 1% up to about 10%, or to about 7%, or to about 5% by weight of the lubricating compositions.

Materials which may be sulfurized to form the sulfurized organic compositions include oils, fatty acids or esters, olefins or polyolefins made thereof, terpenes, or Diels-Alder adducts.

Oils which may be sulfurized are natural or synthetic oils including mineral oils, lard oil, carboxylic acid esters derived from aliphatic alcohols and fatty acids or aliphatic carboxylic acids (e.g., myristyl oleate and oleyl oleate) sperm whale oil and synthetic sperm whale oil substitutes and synthetic unsaturated esters or glycerides.

Fatty acids generally contain from about 4, or about 8, or about 12 to about 30, or to about 24, or to about 18 carbon atoms. The unsaturated fatty acids generally contained in the naturally occurring vegetable or animal fats and oils may contain one or more double bonds and such acids include palmitoleic acid, oleic acid, linoleic acid, linolenic acid, and erucic acid. The unsaturated fatty acids may comprise mixtures of acids such as those obtained from naturally occurring animal and vegetable oils such as lard oil, tall oil, peanut oil, soybean oil, cottonseed oil, sunflower seed oil, rapeseed oil, or wheat germ oil. Tall oil is a mixture of rosin acids, mainly abietic acid, and unsaturated fatty acids, mainly oleic and linoleic acids. Tall oil is a by-product of the sulfate process for the manufacture of wood pulp.

The unsaturated fatty acid esters are the fatty oils, that is, naturally occurring esters of glycerol with the fatty acids described above, and synthetic esters of similar structure. Examples of naturally occurring fats and oils containing unsaturation include animal fats such as Neat's-foot oil, lard oil, depot fat, beef tallow, etc. Examples of naturally occurring vegetable oils include cottonseed oil, corn oil, poppy-seed oil, safflower oil, sesame oil, soybean oil, funflower seed oil and wheat germ oil.

The fatty acid esters also may be prepared from aliphatic olefinic acids of the type described above such as oleic acid, linoleic acid, linolenic acid, and erucic acid by reaction with alcohols and polyols. Examples of aliphatic alcohols which may be reacted with the above-identified acids include monohydric alcohols as described above. Examples of these alcohols include methanol, ethanol, propanol, and butanol. Polyhydric alcohols are described above and include ethylene glycol, propylene glycol, trimethylene glycol, neopentyl glycol, glycerol, etc.

The olefinic compounds which may be sulfurized are diverse in nature. They contain at least one olefinic double bond, which is defined as a non-aromatic double bond; that is, one connecting two aliphatic carbon atoms. In its broadest sense, the olefin may be defined by the formula $R^{*1}R^{*2}C{=}CR^{*3}R^{*4}$, wherein each of $R^{*1}$, $R^{*2}$, $R^{*3}$ and $R^{*4}$ is hydrogen or an organic group. In general, the $R^*$ groups in the above formula which are not hydrogen may be represented by $-(CH_2)_n-A$ wherein n is a number from 0 to 10 and A is represented by $-C(R^{*5})_3$, $-COOR^{*5}$, $-CON(R^{*5})_2$, $-COON(R^{*5})_4$, $-COOM$, $-CN$, $-X$, $-YR^{*5}$ or $-Ar$, wherein:

each $R^{*5}$ is independently hydrogen, alkyl, alkenyl, aryl, substituted alkyl, substituted alkenyl or substituted aryl, with the proviso that any two $R^{*5}$ groups can be alkylene or substituted alkylene whereby a ring of up to about 12 carbon atoms is formed;

M is one equivalent of a metal cation (preferably Group I or II, e.g., sodium, potassium, barium, calcium);

X is halogen (e.g., chloro, bromo, or iodo);

Y is oxygen or divalent sulfur;

Ar is an aryl or substituted aryl group of up to about 12 carbon atoms.

Any two of $R^{*1}$, $R^{*2}$, $R^{*3}$ and $R^{*4}$ may also together form an alkylene or substituted alkylene group; i.e., the olefinic compound may be alicyclic.

The olefinic compound is usually one in which each R group which is not hydrogen is independently alkyl, alkenyl or aryl group. Monoolefinic and diolefinic compounds, particularly the former, are preferred, and especially terminal monoolefinic hydrocarbons; that is, those compounds in which $R^{*3}$ and $R^{*4}$ are hydrogen and $R^{*1}$ and $R^{*2}$ are alkyl or aryl, especially alkyl (that is, the olefin is aliphatic) having 1 to about 30, or to about 16, or to about 8, or even to about 4 carbon atoms. Olefinic compounds having about 3 to about 30, or to about 16 (most often less than about 9) carbon atoms are particularly desirable.

Isobutene, propylene and their dimers, trimers and tetramers, and mixtures thereof are especially preferred olefinic compounds. Of these compounds, isobutylene and diisobutylene are particularly desirable because of their availability and the particularly high sulfur containing compositions which can be prepared therefrom.

In another embodiment, the sulfurized organic compound is a sulfurized terpene compound. The term "terpene compound" as used in the specification and claims is intended to include the various isomeric terpene hydrocarbons having the empirical formula $C_{10}H_{16}$, such as contained in turpentine, pine oil and dipentenes, and the various synthetic and naturally occurring oxygen-containing derivatives. Mixtures of these various compounds generally will be utilized, especially when natural products such as pine oil and turpentine are used. A group of pine oil-derived products are available commercially from Hercules Incorporated. It has been found that the pine oil products generally known as terpene alcohols available from Hercules Incorporated are useful in the preparation of the sulfurized organic compositions. Examples of such products include alpha-Terpineol containing about 95–97% of alpha-terpineol, a high purity tertiary terpene alcohol mixture typically containing 96.3% of tertiary alcohols; Terpineol 318 Prime which is a mixture of isomeric terpineols obtained by dehydration of terpene hydrate and contains about 60–65 weight percent of alpha-terpineol and 15–20% beta-terpineol, and 18–20% of other tertiary terpene alcohols. Other mixtures and grades of useful pine oil products also are available from Hercules under such designations as Yarmor 302, Herco pine oil, Yarmor 302W, Yarmor F and Yarmor 60.

In one embodiment, sulfurized olefins are produced by (1) reacting sulfur monochloride with a stoichiometric excess of a low carbon atom olefin, (2) treating the resulting product with an alkali metal sulfide in the presence of free sulfur in a mole ratio of no less than 2:1 in an alcohol-water solvent, and (3) reacting that product with an inorganic base. This procedure is described in U.S. Pat. No. 3,471,404, and the disclosure of U.S. Pat. No. 3,471,404 is hereby incorporated by reference for its discussion of this procedure for preparing sulfurized olefins and the sulfurized olefins thus produced. Generally, the olefin reactant contains from about 2 to 5 carbon atoms and examples include ethylene, propylene, butylene, isobutylene, amylene, etc.

The sulfurized olefins which are useful in the compositions of the present invention also may be prepared by the reaction, under superatmospheric pressure, of olefinic compounds with a mixture of sulfur and hydrogen sulfide in the presence of a catalyst, followed by removal of low boiling materials. This procedure for preparing sulfurized compositions which are useful in the present invention is described in U.S. Pat. No. 4,191,659, the disclosure of which is hereby incorporated by reference for its description of the preparation of useful sulfurized compositions. In one embodiment, the sulfurized olefin is prepared by reacting 16 moles of isobutylene with 16 moles of sulfur and 8 moles of hydrogen sulfide.

In another embodiment, the sulfurized organic composition is at least one sulfur-containing material which comprises the reaction product of a sulfur source and at least one Diels-Alder adduct in a molar ratio of at least 0.75:1. Generally, the molar ratio of sulfur source to Diels-Alder adduct is in a range of from about 0.75, or about 1, to about 4, or to about 3, or to about 2.5.

The Diels-Alder adducts are a well-known, art-recognized class of compounds prepared from dienes by the Diels-Alder reaction. A summary of the prior art relating to this class of compounds is found in the Russian monograph, *Dienovyi Sintes*, Izdatelstwo Akademii Nauk SSSR, 1963 by A. S. Onischenko. (Translated into the English language by L. Mandel as A. S. Onischenko, *Diene Synthesis*, N.Y., Daniel Davey and Co., Inc., 1964.) This monograph and references cited therein are incorporated by reference into the present specification.

Basically, the Diels-Alder reaction involves the reaction of at least one conjugated diene with at least one ethylenically or acetylenically unsaturated compound, these latter compounds being known as dienophiles. Piperylene, isoprene, methylisoprene, chloroprene, and 1,3-butadiene are among the preferred dienes for use in preparing the Diels-Alder adducts.

In addition to these linear 1,3-conjugated dienes, cyclic dienes are also useful as reactants in the formation of the Diels-Alder adducts. Examples of these cyclic dienes are the cyclopentadienes, fulvenes, 1,3-cyclohexadienes, 1,3-cycloheptadienes, 1,3,5-cycloheptatrienes, cyclooctatetraene, and 1,3,5-cyclononatrienes. Various substituted derivatives of these compounds enter into the diene synthesis.

Dienophiles, useful in preparing the Diels-Alder adducts, include those having at least one electron-accepting groups selected from groups such as formyl, cyano, nitro, carboxy, carbohydrocarbyloxy, hydrocarbylcarbonyl, hydrocarbylsulfonyl, carbamyl, acylcarbamyl, N-acyl-N-hydrocarbylcarbamyl, N-hydrocarbylcarbamyl, and N,N-dihydrocarbylcarbamyl. The dienophiles include: nitroalkenes; alpha, beta-ethylenically unsaturated carboxylic esters, acids or amides; ethylenically unsaturated aldehydes and vinyl ketones. Specific examples of dienophiles include 1-nitrobutene-1, alkylacrylates, acrylamide, dibutylacrylamide, methacrylamide, crotonaldehyde; crotonic acid, dimethyldivinyl ketone, methylvinyl ketone and the like.

Another class of dienophiles are those having at least one carboxylic ester group represented by —C(O)O—$R_o$ where $R_o$ is the residue of a saturated aliphatic alcohol of up to about 40 carbon atoms, the aliphatic alcohol from which —$R_o$ is derived can be any of the mono or polyhydric alcohols described above. In this class of dienophiles, not more than two —C(O)—O—$R_o$ groups will be present, preferably only one —C(O)—O—$R_o$ group.

In addition to the ethylenically unsaturated dienophiles, there are many useful acetylenically unsaturated dienophiles such as propiolaldehyde, methyl ethynyl ketone, propyl ethynyl ketone, propenyl ethynyl ketone, propiolic acid, propiolic acid nitrile, ethylpropiolate, tetrolic acid, propargylaldehyde, acetylene-dicarboxylic acid, the dimethyl ester of acetylenedicarboxylic acid, dibenzoylacetylene, and the like.

Cyclic dienophiles include cyclopentenedione, coumaran, 3-cyanocoumaran, dimethyl maleic anhydride, 3,6-endomethylene-cyclohexenedicarboxylic acid, etc.

Normally, the adducts involve the reaction of equimolar amounts of diene and dienophile. However, if the dienophile has more than one ethylenic linkage, it is possible for additional diene to react if present in the reaction mixture.

The sulfurized Diels-Alder adducts are readily prepared by heating a mixture of a sulfur source, preferably sulfur and at least one of the Diels-Alder adducts of the types discussed hereinabove at a temperature within the range of from about 110° C. to just below the decomposition temperature of the Diels-Alder adducts. Temperatures within the range of about 110° C. to about 200° C. will normally be used.

The reaction can be conducted in the presence of suitable inert organic solvents such as mineral oils, kerosenes, toluenes, benzenes, alkanes of 7 to 18 carbons, etc., although no solvent is generally necessary. After completion of the reaction, the reaction mass can be filtered and/or subjected to other conventional purification techniques. An example of a useful sulfurized Diels-Alder adduct is a sulfurized reaction product of butadiene and butyl-acrylate.

Other Additives

The invention also contemplates the use of other additives in combination with the reaction products, or salts thereof. Such additives include, for example, detergents and dispersants of the ash-producing or ashless type, corrosion- and oxidation-inhibiting agents, pour point depressing agents, extreme pressure agents, antiwear agents, color stabilizers and anti-foam agents.

The ash-producing detergents are exemplified by oil-soluble neutral and basic salts (i.e. overbased salts) of alkali or alkaline earth metals with sulfonic acids, carboxylic acids, phenols or organic phosphorus acids characterized by at least one direct carbon-to-phosphorus linkage such as those prepared by the treatment of an olefin polymer (e.g., polyisobutene having a molecular weight of 1000) with a phosphorizing agent such as phosphorus trichloride, phosphorus heptasulfide, phosphorus pentasulfide, phosphorus trichloride and sulfur, white phosphorus and a sulfur halide, or phosphorothioic chloride. The most commonly used salts of such acids are those of sodium, potassium, lithium, calcium, magnesium, strontium and barium.

The term "basic salt" is used to designate metal salts wherein the metal is present in stoichiometrically larger amounts than the organic acid radical. The basic salt typically has a base metal ratio of about 1.5, or about 3, or about 5 up to about 40, or to about 30, or to about 25. The commonly employed methods for preparing the basic salts involve heating a mineral oil solution of an acid with a stoichiometric excess of a metal neutralizing agent such as the metal oxide, hydroxide, carbonate, bicarbonate, or sulfide at a temperature of about 50° C. and filtering the resulting mass. The use of a "promoter" in the neutralization step to aid the incorporation of a large excess of metal likewise is known. Examples of compounds useful as the promoter include phenolic substances such as phenol, naphthol, alkylphenol, thiophenol, sulfurized alkylphenol, and condensation products of formaldehyde with a phenolic substance; alcohols such as methanol, 2-propanol, octyl alcohol, cellosolve, carbitol, ethylene glycol, stearyl alcohol, and cyclohexyl alcohol; and amines such as aniline, phenylenediamine, phenothiazine, phenyl-betanaphthylamine, and dodecylamine. A particularly effective method for preparing the basic salts comprises mixing an acid with an excess of a basic alkaline earth metal neutralizing agent and at least one alcohol promoter, and carbonating the mixture at an elevated temperature such as 60°-200° C.

The oil-soluble neutral or basic salts of alkali or alkaline earth metal salts may also be reacted with a boron compound. Boron compounds include boron oxide, boric acid and esters of boric acid, preferably boric acid. Patents describing techniques for making basic salts of sulfonic, carboxylic acids and mixtures thereof include U.S. Pat. Nos. 2,501,731; 2,616,911; 2,777,874; 3,384,585; 3,320,162; 3,488,284 and 3,629,109. The disclosure of these patents are hereby incorporated by reference. Borated overbased compositions, lubricating compositions contain the same in methods of preparing borated overbased compositions are found in U.S. Pat. No. 4,744,920; 4,792,410 and PCT publication WO 88/03144. The disclosure of these references are hereby incorporated by reference.

Ashless detergents and dispersants, depending on its constitution, may upon combustion yield a non-volatile material such as boric oxide or phosphorus pentaoxide. The ashless detergents and dispersants do not ordinarily contain metal and, therefore, do not yield a metal-containing ash on combustion. Many types are known in the art. The following are illustrative.

(1) "Carboxylic dispersants" are the reaction products of carboxylic acids (or derivatives thereof) containing at least about 34 and preferably at least about 54 carbon atoms and nitrogen containing compounds (such as amine), organic hydroxy compounds (such as phenols and alcohols), and/or basic inorganic materials. These reaction products include imide, amide, and ester reaction products of carboxylic acylating agents. The above-described acylated nitrogen-containing compounds are examples of carboxylic dispersants. Examples of these materials include succinimide dispersants and carboxylic ester dispersants. Examples of these "carboxylic dispersants" are described in British Patent 1,306,529 and in many U.S. Patents including the following: U.S. Pat. Nos. 3,219,666, 3,316,177, 3,340,281, 3,351,552, 3,381,022, 3,433,744, 3,444,170, 3,467,668, 3,501,405, 3,542,680, 3,576,743, 3,632,511, 4,234,435, and Re 26,433.

(2) "Amine dispersants" are the reaction products of relatively high molecular weight aliphatic or alicyclic halides and amines, preferably polyalkylene polyamines. These dispersants are described above as polyalkene-substituted amines. Examples thereof are described for example, in the following U.S. Pat. Nos. 3,275,554, 3,438,757, 3,454,555, and 3,565,804.

(3) "Mannich dispersants" are the reaction products of alkylphenols in which the alkyl group contains at least about 30 carbon atoms and aldehydes (especially formaldehyde) and amines (especially amine condensates and polyalkylenepolyamines). The materials described in the following U.S. Patents are illustrative: U.S. Pat. Nos. 3,036,003, 3,236,770, 3,414,347, 3,448,047, 3,461,172, 3,539,633, 3,586,629, 3,591,598, 3,634,515, 3,725,480, 3,726,882, and 3,980,569.

(4) "Post-treated dispersants" are the products obtained by post-treating the carboxylic, amine or Mannich dispersants with reagents such as urea, thiourea, carbon disulfide, aldehydes, ketones, carboxylic acids, hydrocarbon-substituted succinic anhydrides, nitriles, epoxides, boron compounds, phosphorus compounds or the like. Exemplary materials of this kind are described in the following U.S. Pat. Nos. 3,200,107, 3,282,955, 3,367,943, 3,513,093, 3,639,242, 3,649,659, 3,442,808, 3,455,832, 3,579,450, 3,600,372, 3,702,757, and 3,708,422.

(5) "Polymeric dispersants" are interpolymers of oil-solubilizing monomers such as decyl methacrylate, vinyl decyl ether and high molecular weight olefins with monomers containing polar substituents, e.g., aminoalkyl acrylates or acrylamides and poly-(oxyethylene)-substituted acrylates. Polymeric dispersants include esters of styrene-maleic anhydride copolymers. Examples thereof are disclosed in the following U.S. Pat. Nos. 3,329,658, 3,449,250, 3,519,656, 3,666,730, 3,687,849, and 3,702,300.

The above-noted patents are incorporated by reference herein for their disclosures of ashless dispersants.

Auxiliary extreme pressure agents and corrosion- and oxidation-inhibiting agents which may be included in the lubricants of the invention are exemplified by chlorinated aliphatic hydrocarbons such as chlorinated wax; sulfurized alkylphenol; phosphosulfurized hydrocarbons such as the reaction product of a phosphorus sulfide with turpentine or methyl oleate, phosphorus esters including principally dihydrocarbyl and trihydrocarbyl phosphites such as dibutyl phosphite, diheptyl phosphite, dicyclohexyl phosphite, triphenyl phosphite, pentyl phenyl phosphite, dipentyl phenyl phosphite, tridecyl phosphite, distearyl phosphite, dimethyl naphthyl phosphite, oleyl 4-pentyl phenyl phosphite, polypropylene (number molecular weight 500)-substituted phenyl phosphite, diisobutyl-substituted phenyl phosphite; metal thiocarbamates, such as zinc dioctyldithiocarbamate, and barium diheptylphenyl dithiocarbamate; amine dithiocarbamates; dithiocarbamate esters, such as reaction products of an amine, (e.g., butylamine), carbon disulfide and unsaturated compounds selected from acrylic, methacrylic, maleic, or fumaric acids, esters, or salts and acrylamides; and alkylene- or sulfur-coupled dithiocarbamate such as methylene or phenylene coupled bis(dibutyldithiocarbamates).

Many of the above-mentioned extreme pressure agents and corrosion- and oxidation-inhibitors also serve as antiwear agents.

Pour point depressants are a particularly useful type of additive often included in the lubricating oils described herein. The use of such pour point depressants in oil-based compositions to improve low temperature properties of oil-based compositions is well known in the art. See, for example, page 8 of "Lubricant Additives" by C. V. Smallheer and R. Kennedy Smith (Lezius-Hiles Co. publishers, Cleveland, Ohio, 1967).

Examples of useful pour point depressants are polymethacrylates; polyacrylates; polyacrylamides; condensation products of haloparaffin waxes and aromatic compounds; vinyl carboxylate polymers; and polymers of dialkylfumarates, vinyl esters of fatty acids and alkyl vinyl ethers. Pour point depressants useful for the purposes of this invention, techniques for their preparation and their uses are described in U.S. Pat. Nos. 2,387,501; 2,015,748; 2,655,479; 1,815,022; 2,191,498; 2,666,746; 2,721,877; 2,721,878; and 3,250,715 which are hereby incorporated by reference for their relevant disclosures.

Antifoam agents are used to reduce or prevent the formation of stable foam. Typical antifoam agents include silicones or organic polymers. Additional antifoam compositions are described in "Foam Control Agents", by Henry T. Kerner (Noyes Data Corporation, 1976), pages 125–162.

EXAMPLES I–VIII

The following examples relate to lubricating compositions containing (A) reaction products of dimercaptothiadiazole (i) and an alpha, beta-unsaturated ester (ii) and their salts.

EXAMPLE I

A lubricant is prepared by incorporating 3% by weight of the product of Example 1 into a SAE 10W-40 lubricating oil mixture.

EXAMPLE II

A gear lubricant is prepared by incorporating 2.5% by weight of the product of Example 6 into an SAE 90 lubricating oil mixture.

EXAMPLE III

A gear lubricant is prepared by incorporating 3% by weight of the product of Example 1, and 4% by weight of a polysulfide prepared from butylene, sulfur and hydrogen sulfide into an SAE 80W-90 lubricating oil mixture.

EXAMPLE IV

A lubricant is prepared as described in Example III except a SAE 10W-40 lubricating oil mixture is used in place of the SAE 80W-90 lubricating oil mixture.

EXAMPLE V

A gear lubricant is prepare by incorporating 3% by weight the product of Example 11, and 1.9% by weight of a zinc isopropyl, methylamyl dithiophosphate into an SAE 75W-90 lubricating oil mixture.

EXAMPLE VI

A lubricant is prepared as described in Example V except an SAE 10W-30 lubricating oil mixture is used in place of the SAE 80W-90 lubricating oil mixture.

EXAMPLE VII

A gear lubricant is prepared by incorporating 3% by weight the product of Example 11, and 0.5% by weight of a succinic dispersant prepared by reacting a polybutenyl-substituted succinic anhydride, with a polybutenyl group having a number average molecular weight of about 950, with a commercial polyamine having the equivalent structure of tetraethylene pentamine into a SAE 75W-90 lubricant oil mixture.

EXAMPLE VIII

A lubricant is prepared as described in Example VII except an SAE 10W-30 lubricating oil mixture is used in place of the SAE 75W-90 lubricant oil mixture.

EXAMPLE IX

A lubricant is prepared by incorporating 2% by weight of the product of Example 1, 2.8% of a propyleneoxide post-treated dimethylamyldithiophosphate, 0.3% of a calcium overbased tall oil acid having a metal ratio of 200 and a total base number of 125, 0.2 parts of DuomeenT® (N-tallow trimethylenediamine, available from Akzo Chemical, Inc.), 0.8% of a silicon foam agent, 0.4% by weight of a maleic anhydride-styrene copolymer esterified with $C_{8-18}$ and $C_4$ alcohols and post-treated with aminopropylmorpholine into a mixture of a 600 neutral mineral oil available commercially from Exxon Chemical Company as FN1254 (specific gravity 0.89) and a 150 bright stock available commercially from Exxon Chemical company as FN2507 (specific gravity 0.90).

EXAMPLE X

The lubricant is prepared as described in Example IX except 1% by weight of a sulfurized olefin prepared by reacting isobutylene with sulfur monochloride followed by a reaction with sodium sulfide and caustic solution replaces 1% by weight of the 600 neutral mineral oil.

EXAMPLE XI

A lubricant is prepared as described in Example IX except 2% by weight of the product of Example 3 is used in place of the product of Example 1.

The antiwear and extreme pressure properties of lubricants containing the additives derived from dimercaptothiadiazoles are illustrated in the Shell 4-ball EP test (ASTM 2783). The 4-ball EP test runs at a fixed speed of 1770±60 RPM's and has no provision for lubricant control. The test measures a lubricant's protection under conditions of high unit pressures and moderate sliding velocities. The procedure involves running a series of tests over a range of increasing loads until welding occurs. The mean load, for the lubricant being tested, is calculated from the scar measurements. The mean load is known as the load-wear index. The weld point is the lowest load in kilograms at which the welding occurs. The seizure is the load in kilograms which occurs when seizure scars form.

The following table contains test data on lubricants containing reaction products or salts thereof in lubricating compositions.

| Example | Seizure | Weld | LWI |
|---|---|---|---|
| IX | 100 | 250 | 45.21 |
| X | 100 | 250 | 48.07 |
| XI | 100 | 250 | 39.96 |

As can be seen from the above data, the additives which are the reaction products of an alpha, beta-unsaturated ester and a dimercaptothiadiazole, and their salts provide extreme pressure and antiwear properties to lubricating compositions.

When the alpha, beta-unsaturated esters are fatty esters, then the resulting reaction products and salts thereof provide improvement in friction properties to fluids, such as lubricants, greases, and aqueous fluids. Fatty esters are those esters having from 8, or about 10 to about 30, or to about 24 carbon atoms in the alkoxy portion of the ester.

Grease

Where the lubricant is to be used in the form of a grease, the lubricating oil generally is employed in an amount sufficient to provide the balance of the total grease composition and, generally, the grease compositions will contain various quantities of thickening agents and other additive components to provide desirable properties. The reaction products or salts thereof are present in an amount from about 0.5%, or about 1% to about 10%, or to about 5% by weight.

A wide variety of thickeners can be used in the preparation of the greases of this invention. The thickeners is employed in an amount from about 0.5 to about 30 percent, and preferably from 3 to about 15 percent by weight of the total grease composition. Including among the thickeners are alkali and alkaline earth metal soaps of fatty acids and fatty materials having from about 12 to about 30 carbon atoms. The metals are typified by sodium, lithium, calcium and barium. Examples of fatty materials include stearic acid, hydroxystearic acid, stearin, oleic acid, palmetic acid, myristic acid, cottonseed oil acids, and hydrogenated fish oils.

Other thickeners include salt and salt-soap complexes, such as calcium stearate-acetate (U.S. Pat. No. 2,197,263), barium stearate-acetate (U.S. Pat. No. 2,564,561), calcium stearate-caprylate-acetate complexes (U.S. Pat. No. 2,999,066), calcium salts and soaps of low-intermediate- and high-molecular weight acids and of nut oil acids, aluminum stearate, and aluminum complex thickeners.

Particularly useful thickening agents employed in the grease compositions are essentially hydrophilic in character, but which have been converted into a hydrophobic condition by the introduction of long chain hydrocarbyl radicals onto the surface of the clay particles prior to their use as a component of a grease composition, as, for example, by being subjected to a preliminary treatment with an organic cationic surface-active agent, such as an ammonium compound. Typical ammonium compounds are tetraalkyl ammonium chlorides, such as dimethyl dioctadecyl ammonium chloride, dimethyl dibenzyl ammonium chloride and mixtures thereof. This method of conversion, being well known to those skilled in the art, is believed to require no further discussion.

The clays which are useful as starting materials in forming the thickeners to be employed in the grease compositions can comprise the naturally occurring chemically unmodified clays. These clays are crystalline complex silicates, the exact composition of which is not subject to precise description, since they vary widely from one natural source to another. These clays can be described as complex inorganic silicates such as aluminum silicates, magnesium silicates, barium silicates and the like, containing, in addition to the silicate lattice, varying amounts of cation-exchangeable groups such as sodium. Hydrophilic clays which are particularly useful for conversion to desired thickening agents include montmorillonite clays, such as bentonite, attapulgite, hectorite, illite, saponite, sepiolite, biotite, vermiculite, zeolite clays and the like.

Aqueous Compositions

The invention also includes aqueous compositions characterized by an aqueous phase with at least one reaction product or salt of the reaction product dispersed or dissolved in said aqueous phase. Preferably, this aqueous phase is a continuous aqueous phase although, in some embodiments, the aqueous phase can be a discontinuous phase. These aqueous compositions usually contain at least about 25% by weight water. Such aqueous compositions encompass both concentrates containing about 25% to about 80% by weight, preferably from about 40% to about 65% water; and water-based functional fluids containing generally over about 80% by weight of water. The concentrates generally contain less than about 50%, preferably less than about 25%, more preferably less than about 15%, and still more preferably less than about 6% hydrocarbon oil. The water-based functional fluids generally contain less than about 15%, preferably less than about 5%, and more preferably less than about 2% hydrocarbon oil. In one embodiment, the aqueous composition is a water-in-oil emulsion.

The reaction product or salts of the reaction product are generally present in the aqueous compositions in an amount from about 0.2%, or about 0.5%, or about 0.75% up to about 10%, or to about 5%, or to about 2.5% of the aqueous composition.

These concentrates and water-based functional fluids can optionally include other conventional additives commonly employed in water-based functional fluids. These other additives include surfactants; thickeners; oil-soluble, water-insoluble functional additives such as antiwear agents, extreme pressure agents, dispersants, etc.; and supplemental additives such as corrosion-inhibitors, shear stabilizing agents, bactericides, dyes, water-softeners, odor masking agents, antifoam agents and the like.

The water-based functional fluids may be in the form of solutions; or micelle dispersions or microemulsions which appear to be true solutions.

Surfactants

The surfactants that are useful in the aqueous compositions of the invention can be of the cationic, anionic, nonionic or amphoteric type. Many such surfactants of each type are known to the art. See, for example, McCutcheon's "Emulsifiers & Detergents", 1981, North American Edition, published by McCutcheon Division, MC Publishing Co., Glen Rock, New Jersey, U.S.A., which is hereby incorporated by reference for its disclosures in this regard.

Among the nonionic surfactant types are the alkylene oxide treated products, such as ethylene oxide treated phenols, alcohols, esters, amines and amides. Ethylene oxide/propylene oxide block copolymers are also useful nonionic surfactants. Glycerol esters and sugar esters are also known to be nonionic surfactants. A typical nonionic surfactant class useful with the present invention is the alkylene oxide treated alkylphenols such as the ethylene oxide-alkylphenol condensates. Examples of alkylene oxide treated alkylphenols are sold commercially under the tradename of Triton ® available commercially from Union Carbide Chemical Company. A specific example of these is Triton ® X-100 which contains an average of 9–10 ethylene oxide units per molecule, has an HLB value of about 13.5 and a molecular weight of about 628.

The alkoxylated amines useful as surfactants include polyalkoxylated amines and are available from Akzo Chemie under the names ETHODUOMEEN ® polyethoxylated diamines; ETHOMEEN ®, polyethoxylated aliphatic amines; ETHOMID ®, polyethoxylated amides; and ETHOQUAD, polyethoxylated quaternary ammonium chlorides.

The acids useful as surfactants are acids derived from tall oil acids, which are distilled mixtures of acids comprising chiefly oleic and linoleic acid. Preferred tall oil acids are mixtures of rosin acids and fatty acids sold under the trade name Unitol DT/40 (available from Union Camp Corp). Many other suitable nonionic surfactants are known; see, for example, the aforementioned McCutcheon's as well as the treatise "Non-Ionic Surfactants" edited by Martin J. Schick, M. Dekker Co., New York, 1967, which is herein incorporated by reference for its disclosures in this regard.

As noted above, cationic, anionic and amphoteric surfactants can also be used. Generally, these are all hydrophilic surfactants. A general survey of useful surfactants is found in Kirk-Othmer Encyclopedia of Chemical Technology, Second Edition, Volume 19, page 507 et seq. (1969, John Wiley and Son, New York) and the aforementioned compilation published under the name of McCutcheon's. These references are both hereby incorporated by reference for their disclosures relating to cationic, amphoteric and anionic surfactants.

Among the useful anionic surfactant types are the widely known carboxylate soaps, metal organosulfates, metal sulfonates, metal sulfonylcarboxylates, and metal phosphates. Useful cationic surfactants include nitrogen compounds such as amine oxides and the well-known quaternary ammonium salts. Amphoteric surfactants include amino acid-type materials and similar types. Various cationic, anionic, and amphoteric surfactants are available from the industry, particularly from such companies as Rohm & Haas and Union Carbide Corporation, both of America. Further information about anionic and cationic surfactants also can be found in the texts "Anionic Surfactants", Parts II and III, edited by W. M. Linfield, published by Marcel Dekker, Inc., New York, 1976 and "Cationic Surfactants", edited by E. Jungermann, Marcel Dekker, Inc., New York, 1976. Both of these references are incorporated by reference for their disclosures in this regard.

Surfactants are generally employed in effective amounts to aid in the dispersal of the various additives, particularly in the functional additives discussed below of the invention. Preferably, the concentrates can contain up to about 75% by weight, more preferably from about 10% to about 75% by weight of one or more of these surfactants. The water-based functional fluids can contain up to about 15% by weight, more preferably from about 0.05% to about 15% by weight of one or more of these surfactants.

Thickener

Often the aqueous compositions of this invention contain at least one thickener. Generally, these thickeners can be polysaccharides, synthetic thickening polymers, or mixtures of two or more of these. Among the polysaccharides that are useful are natural gums such as those disclosed in "Industrial Gums" by Whistler and B. Miller, published by Academic Press, 1959. Disclosures in this book relating to watersoluble thickening natural gums is hereby incorporated by reference. Specific examples of such gums are gum agar, guar gum, gum arabic, algin, dextrans, xanthan gum and the like. Also among the polysaccharides that are useful as thickeners for the aqueous compositions of this invention are cellulose ethers and esters, including hydroxyhydrocarbylcellulose and hydrocarbylhydroxycellulose and its salts. Specific examples of such thickeners are hydroxyethylcellulose and the sodium salt of carboxymethylcellulose. Mixtures of two or more of any such thickeners are also useful.

It is a general requirement that the thickener used in the aqueous compositions of the present invention be soluble in both cold (10° C.) and hot (about 90° C.) water. This excludes such materials as methylcellulose which is soluble in cold water but not in hot water. Such hot water-insoluble materials, however, can be used to perform other functions such as providing lubricity to the aqueous compositions of this invention.

A thickener can also be synthetic thickening polymers. Many such polymers are known to those of skill in the art. Representative of them are polyacrylates, polyacrylamides, hydrolyzed vinyl esters, water-soluble homo- and interpolymers of acrylamidoalkane sulfonates containing 50 mole percent at least of acrylamidoalkane sulfonate and other comonomers such as acrylonitrile, styrene and the like.

Other useful thickeners are known to those of skill in the art and many can be found in the list in the aforementioned McCutcheon Publication: "Functional Materials," 1976, pp. 135–147, inclusive. The disclosures therein, relative to water-soluble polymeric thickening agents meeting the general requirements set forth above are hereby incorporated by reference.

Preferred thickeners, particularly when the compositions of the invention are required to be stable under high shear applications, are the water-dispersible reaction products formed by reacting at least one hydrocarbyl-substituted succinic acid and/or anhydride wherein the hydrocarbyl group has from about 8 or about 12, or about 16, to about 40, or to about 30, or to about 24, or to about 18 carbon atoms, with at least one water-dispersible amine terminated poly(oxyalkylene) or at least one water-dispersible hydroxy-terminated polyoxyalkylene.

Examples of water-dispersible amine-terminated poly(oxyalkylene)s that are useful in accordance with the present invention are disclosed in U.S. Pat. Nos. 3,021,232; 3,108,011; 4,444,566; and Re 31,522. The disclosures of these patents are incorporated herein by reference. Water-dispersible amine terminated poly(oxyalkylene)s that are useful are commercially available from the Texaco Chemical Company under the trade name Jeffamine ®.

The water-dispersible hydroxy-terminated polyoxyalkylenes are constituted of block polymers of propylene oxide and ethylene oxide, and a nucleus which is derived from organic compounds containing a plurality of reactive hydrogen atoms. The block polymers are attached to the nucleus at the sites of the reactive hydrogen atoms. These compounds are commercially available from BASF Wyandotte Corporation under the tradename "Tetronic". Additional examples include the hydroxy-terminated polyoxyalkylenes which are commercially available from BASF Wyandotte Corporation under the tradename "Pluronic". Useful hydroxy-terminated polyoxyalkylenes are disclosed in U.S. Pat. Nos. 2,674,619 and 2,979,528, which are incorporated herein by reference.

The reaction between the succinic acid and/or anhydride and the amine- or hydroxy-terminated polyoxyalkylene can be carried out at a temperature in the range of about 60° C. to about 160° C., preferably about 120° C. to about 160° C. The ratio of equivalents of carboxylic agent to polyoxyalkylene preferably ranges from about 0.1:1 to about 8:1, preferably about 1:1 to about 4:1, and advantageously about 2:1. The reaction products may be used as salts or may form salts when added to concentrates and fluids containing metals or amines.

U.S. Pat. No. 4,659,492 is incorporated herein by reference for its teachings with respect to the use of hydrocarbyl-substituted succinic acid or anhydride/hydroxy-terminated poly(oxyalkylene) reaction products as thickeners for aqueous compositions.

When the thickener is formed using an amine-terminated poly(oxyalkylene), the thickening characteristics of said thickener can be enhanced by combining it with at least one surfactant. Any of the surfactants identified above can be used in this regard. When such surfactants are used, the weight ratio of thickener to surfactant is generally in the range of from about 1:5 to about 5:1, preferably from about 1:1 to about 3:1.

Typically, the thickener is present in a thickening amount in the aqueous compositions of this invention. When used, the thickener is preferably present at a level of up to about 70% by weight, preferably from about 20% to about 50% by weight of the concentrates of the invention. The thickener is preferably present at a level in the range of from about 1.5% to about 10% by weight, preferably from about 3% to about 6% by weight of the functional fluids of the invention.

Functional Additives

The functional additives that can be used in the aqueous systems are typically oil-soluble, water-insoluble additives which function in conventional oil-based systems as extreme pressure agents, anti-wear agents, load-carrying agents, dispersants, friction modifiers, lubricity agents, etc. They can also function as anti-slip agents, film formers and friction modifiers. As is well known, such additives can function in two or more of the above-mentioned ways; for example, extreme pressure agents often function as load-carrying agents.

The term "oil-soluble, water-insoluble functional additive" refers to a functional additive which is not soluble in water above a level of about 1 gram per 100 parts of water at 25° C., but is soluble in mineral oil to the extent of at least 1 gram per liter at 25° C.

These functional additives can also include certain solid lubricants such as graphite, molybdenum disulfide and polytetrafluoroethylene and related solid polymers.

These functional additives can also include frictional polymer formers. Polymer forming materials which are dispersed in a liquid are believed to polymerize under operating conditions. A specific example of such materials is dilinoleic acid and ethylene glycol combinations which can form a polyester frictional polymer film. These materials are known to the art and descriptions of them are found, for example, in the journal "Wear", Volume 26, pages 369–392, and West German Published Patent Application 2,339,065. These disclosures are hereby incorporated by reference for their discussions of frictional polymer formers.

Typically these functional additives are known metal or amine salts of organo sulfur, phosphorus, boron or carboxylic acids which are the same as or of the same type as used in oil-based fluids and are described above.

Many such functional additives are known to the art. For example, descriptions of additives useful in conventional oil-based systems and in the aqueous systems of this invention are found in "Advances in Petroleum Chemistry and Refining", Volume 8, edited by John J. McKetta, Interscience Publishers, New York, 1963, pages 31–38 inclusive; Kirk-Othmer "Encyclopedia of Chemical Technology", Volume 12, Second Edition, Interscience Publishers, New York, 1967, page 575 et seq.; "Lubricant Additives" by M. W. Ranney, Noyes Data Corporation, Park Ridge, N.J., U.S.A., 1973; and "Lubricant Additives" by C. V. Smallheer and R. K. Smith, The Lezius-Hiles Co., Cleveland, Ohio, U.S.A. These references are hereby incorporated by reference for their disclosures of functional additives useful in the compositions of this invention.

The functional additive can also be a film former such as a synthetic or natural latex or emulsion thereof in water. Such latexes include natural rubber latexes and polystyrene-butadienes synthetic latex.

The functional additive can also be an anti-chatter or anti-squawk agent. Examples of the former are the amide-metal dithiophosphate combinations such as disclosed in West German Patent 1,109,302; amine salt-azomethane combinations such as disclosed in British Patent Specification 893,977; or amine dithiophosphate such as disclosed in U.S. Pat. No. 3,002,014. Examples of anti-squawk agents are N-acyl-sarcosines and derivatives thereof such as disclosed in U.S. Pat. Nos. 3,156,652 and 3,156,653; sulfurized fatty acids and esters thereof such as disclosed in U.S. Pat. Nos. 2,913,415 and 2,982,734; and esters of dimerized fatty acids such as disclosed in U.S. Pat. No. 3,039,967. The above-cited patents are incorporated herein by reference for their disclosure as pertinent to anti-chatter and anti-squawk agents useful as a functional additive in the aqueous systems of the present invention.

Typically, the functional additive is present in a functionally effective amount. The term "functionally effective amount" refers to a sufficient quantity of an additive to impart desired properties intended by the addition of said additive. For example, if an additive is a rust-inhibitor, a functionally effective amount of the rust-inhibitor would be an amount sufficient to increase the rust-inhibiting characteristics of the composition to which it is added.

The aqueous systems of this invention often contain at least one optional inhibitor for corrosion of either ferrous or non-ferrous metals or both. The optional inhibitor can be organic or inorganic in nature. Many suitable inorganic inhibitors useful in the aqueous systems of the present invention are known to those skilled in the art. Included are those described in "Protective Coatings for Metals" by Burns and Bradley, Reinhold Publishing Corporation, Second Edition, Chapter 13, pages 596–605. This disclosure relative to inhibitors are hereby incorporated by reference. Specific examples of useful inorganic inhibitors include alkali metal nitrites, sodium di- and tripolyphosphate, potassium and dipotassium phosphate, alkali metal borate and mixtures of the same. Specific examples of organic inhibitors include hydrocarbyl amine and hydroxy-substituted hydrocarbyl amine neutralized acid compounds, such as neutralized phosphates and hydrocarbyl phosphate esters, neutralized fatty acids, neutralized aromatic carboxylic acids (e.g., 4-tertiarybutyl benzoic acid), neutralized naphthenic acids and neutralized hydrocarbyl sulfonates. Particularly useful amines include the alkanolamines such as ethanolamine, and diethanolamine.

The aqueous systems of the present invention can also include at least one bactericide. Such bactericides are well known to those of skill in the art and specific examples can be found in the aforementioned McCutcheon publication "Functional Materials" under the heading "Antimicrobials" on pages 9–20 thereof. This disclosure is hereby incorporated by reference as it relates to suitable bactericides for use in the aqueous compositions or systems of this invention. Generally, these bactericides are water-soluble, at least to the extent to allow them to function as bactericides.

The aqueous systems of the present invention can also include such other materials as dyes, e.g., an acid green dye; water softeners, e.g., ethylenediaminetetraacetate sodium salt or nitrilotriacetic acid; odor masking agents, e.g., citronella, oil of lemon, and the like; and antifoamants, such as the well-known silicone antifoamant agents.

The aqueous systems of this invention may also include an antifreeze additive where it is desired to use the composition at a low temperature. Materials such as ethylene glycol and analogous polyoxyalkylene polyols can be used as antifreeze agents. Clearly, the amount used will depend on the degree of antifreeze protection desired and will be known to those of ordinary skill in the art.

It should also be noted that many of the ingredients described above for use in making the aqueous systems of this invention are industrial products which exhibit or confer more than one property on such aqueous compositions. Thus, a single ingredient can provide several functions thereby eliminating or reducing the need for some other additional ingredient. Thus, for example, an extreme pressure agent such as tributyl tin oxide can also function as a bactericide.

Discussion of aqueous compositions and components of aqueous systems occurs in U.S. Pat. No. 4,707,301, herein incorporated by reference for its disclosure of aqueous compositions and components of aqueous compositions.

EXAMPLES IX–XII

The following examples relate to aqueous compositions containing the reaction products of an alpha, beta-unsaturated ester and a dimercaptothiadiazole or salts of the reaction product. The examples are prepared by mixing the components in a homogenizer.

| | IX | X | XI | XII |
|---|---|---|---|---|
| 100 neutral mineral oil | 54.0 | 54.0 | 54.0 | 54.0 |
| Water | 40.0 | 40.0 | 40.0 | 40.0 |
| Reaction product of diethylethanolamine and a polybutenyl-(Mn = 950)-substituted succinic anhydride | 3.0 | 3.5 | 3.0 | 3.5 |
| Product of Example 1 | 0.75 | 1.5 | — | — |
| Product of Example 3 | — | — | 1.0 | 0.9 |
| $(NH_4)_2HPO_4$ | 0.5 | 0.5 | 0.5 | 0.5 |

While the invention has been explained in relation to its preferred embodiments, it is to be understood that various modifications thereof will become apparent to those skilled in the art upon reading the specification. Therefore, it is to be understood that the invention disclosed herein is intended to cover such modifications as fall within the scope of the appended claims.

We claim:

1. A composition comprising (A) a major amount of an oil of lubricating viscosity and (B) a minor amount of (i) a reaction product of (a) at least one dimercaptothiadiazole and (b) at least one alpha, beta-unsaturated ester prepared by reacting an alpha, beta-unsaturated carboxylic acylating agent with a hydroxy compound, or (ii) a salt of the reaction product; provided that when the acylating agent is a monocarboxylic acylating agent then the hydroxy compound is a monohydroxy compound, and provided that when the ester is formed from a maleic acylating agent, then the ester is formed from a sulfur-containing hydroxy compound or a combination of a polyhydroxy compound and a monohydroxy compound.

2. The composition of claim 1, wherein the alpha, beta-unsaturated carboxylic acylating agent contains from 3 to about 10 carbon atoms.

3. The composition of claim 1, wherein the alpha, beta-unsaturated carboxylic acylating agent is an acrylic, methacrylic, maleic, fumaric, itaconic, or crotonic acylating agent.

4. The composition of claim 1, wherein the alpha, beta-unsaturated carboxylic acylating agent is an acrylic or methacrylic acylating agent.

5. The composition of claim 1, wherein the hydroxy compound contains at least 4 carbon atoms.

6. The composition of claim 1, wherein the hydroxy compound contains from 4 to about 30 carbon atoms.

7. The composition of claim 1, wherein the polyhydroxy compound is selected from the group consisting of ethylene glycol, diethylene glycol, trimethylol propane, pentaerythritol, and neopentylglycol.

8. The composition of claim 1, wherein the alpha, beta-unsaturated ester (b) is derived from a combination of a polyhydric alcohol containing from 2 to about 6 hydroxyl groups and 2 to about 40 carbon atoms, and a monohydric alcohol containing at least 4 carbon atoms.

9. The composition of claim 1, wherein the hydroxy compound is a hydroxy-containing sulfur compound.

10. The composition of claim 9 wherein the hydroxy-containing sulfur compound is a hydroxyl-containing thioether.

11. The composition of claim 1, wherein about 0.5 to about 4 moles of the dimercaptothiadiazole (a) is reacted with each mole of the alpha, beta-unsaturated ester (b).

12. The composition of claim 1, wherein approximately equal molar amounts of (a) and (b) are reacted.

13. The composition of claim 1, wherein (B) is (ii) a metal or ammonium salt of the reaction product.

14. The composition of claim 13, wherein the metal of the metal salt is an alkaline earth or transition metal.

15. The composition of claim 13, wherein the metal of the metal salt is zinc.

16. The composition of claim 13, wherein the ammonium salt is derived from a tertiary alkyl primary amine.

17. The composition of claim 1, further comprising (C) at least one metal dithiophosphate or sulfurized organic compound, wherein (C) is other than (A).

18. The composition of claim 1, wherein the lubricating composition is a gear oil.

19. A composition comprising (A) a major amount of an oil of lubricating viscosity and (B) a minor amount of (i) a reaction product of (a) at least one dimercaptothiadiazole, and (b) at least one alpha, beta-unsaturated ester prepared by reacting an alpha, beta-unsaturated monocarboxylic acylating agent with at least one hydroxy compound selected from the group consisting of a monohydroxy compound, and a hydroxy-containing thioether, or (ii) a salt of the reaction product.

20. The composition of claim 19, wherein the alpha, beta-unsaturated monocarboxylic acylating agent is an acrylic or methacrylic acylating agent.

21. The composition of claim 19, wherein the monohydroxy compound is an alcohol having from about 4 to about 30 carbon atoms.

22. The composition of claim 19, wherein the monohydroxy compound is a butyl, pentyl, hexyl, heptyl or octyl alcohol.

23. The composition of claim 19, wherein from about 0.5 to about 4 moles of dimercaptothiadiazole is reacted with about one mole of the alpha, beta-unsaturated ester.

24. A composition comprising (A) a major amount of an oil lubricating viscosity and (B) from about 0.1% by weight of (i) a reaction product of (a) at least one dimercaptothiadiazole, and (b) an acrylic or methacrylic ester, or (ii) salt of the reaction product.

25. The composition of claim 24, wherein the acrylic or methacrylic ester (b) contains from about 4 to about 30 carbon atoms in the alkoxy group.

26. The composition of claim 24, wherein the acrylic or methacrylic ester (b) is a butyl, pentyl, hexyl, heptyl, or octyl ester.

27. The composition of claim 24, wherein (B) is (ii) a metal or ammonium salt of the reaction product.

28. The composition of claim 24, further comprising, (C) at least one metal dithiophosphate or sulfurized organic compound, wherein (C) is other than (A).

29. The composition of claim 24, wherein the oil of lubricating viscosity (A) has a kinematic viscosity of at least about 3.5 Cst at 100° C.

30. A composition comprising (i) the reaction product of (a) at least one dimercaptothiadiazole, and (b) an alpha, beta-unsaturated ester prepared by reacting at least one alpha, beta-unsaturated carboxylic acylating agent with at least one hydroxy-containing thioether, or (ii) a salt of the reaction product.

31. A concentrate comprising (A) a substantially inert organic diluent and (B) from about 10% to about 99% by weight of (i) a reaction product of (a) at least one dimercaptothiadiazole, and (b) at least one alpha, beta-unsaturated ester prepared by reacting an alpha, beta-unsatured carboxylic acylating agent with a hydroxy compound, or (ii) a salt of the reaction product, provided that when the acylating agent is a monocarboxylic acylating agent then the hydroxy compound is a monohydroxy compound, and provided that when the ester is formed from a maleic acylating agent, then the ester is formed from a sulfur-containing hydroxy compound or a combination of a polyhydroxy compound and a monohydroxy compound.

32. An aqueous composition comprising (A) water and (B)(i) a reaction product of (a) at least one dimercaptothiadiazole, and (b) at least one alpha, beta-unsaturated ester prepared by reacting an alpha, beta-unsaturated carboxylic acylating agent with a hydroxy compound, or (ii) a salt of the rection product, provided that when the acylating agent is a monocarboxylic acylating agent then the hydroxy compound is a monohydroxy compound, and provided that when the ester is formed from a maleic acylating agent, then the ester is formed from a sulfur-containing hydroxy compound or a combination of a polyhydroxy compound and a monohydroxy compound.

33. A grease composition comprising an oil of lubricating viscosity, a thickening agent, and (i) a reaction product of (a) at least one dimercaptothiadiazole, and (b) at least one alpha, beta-unsaturated ester prepared by reacting an alpha, beta-unsaturated carboxylic acylating agent with a hydroxy compound, or (ii) a salt of the reaction product, provided that when the acylating agent is monocarboxylic acylating agent then the hydroxy compound is a monohydroxy compound, and provided that when the ester is formed from a maleic acylating agent, then the ester is formed from a sulfur-containing hydroxy compound or a combination of a polyhydroxy compound and a monohydroxy compound.

* * * * *